US006736222B2

(12) United States Patent
Kuckes et al.

(10) Patent No.: US 6,736,222 B2
(45) Date of Patent: May 18, 2004

(54) RELATIVE DRILL BIT DIRECTION MEASUREMENT

(75) Inventors: Arthur F. Kuckes, Ithaca, NY (US); Rahn G. Pitzer, Ithaca, NY (US); Anthony G. Nekut, Ithaca, NY (US)

(73) Assignee: Vector Magnetics, LLC, Ithaca, NY (US)

( * ) Notice: Subject to any disclaimer, the term of this patent is extended or adjusted under 35 U.S.C. 154(b) by 127 days.

(21) Appl. No.: 10/112,860

(22) Filed: Apr. 2, 2002

(65) Prior Publication Data

US 2003/0085059 A1 May 8, 2003

Related U.S. Application Data

(60) Provisional application No. 60/330,963, filed on Nov. 5, 2001.

(51) Int. Cl.[7] ..... E21B 47/024

(52) U.S. Cl. ..... 175/45; 175/40; 175/61; 166/66.5

(58) Field of Search ..... 175/40, 45, 61; 166/66.5; 33/304, 313; 324/345, 346

(56) References Cited

U.S. PATENT DOCUMENTS 5,258,755 A * 11/1993 Kuckes ..... 340/853.5
5,311,952 A * 5/1994 Eddison et al. ..... 175/61
5,419,405 A * 5/1995 Patton ..... 175/27
5,485,089 A * 1/1996 Kuckes ..... 324/346
5,589,775 A * 12/1996 Kuckes ..... 324/346
6,415,878 B1 * 7/2002 Cargill et al. ..... 175/61

* cited by examiner

*Primary Examiner*—David Bagnell
*Assistant Examiner*—Daniel P Stephenson
(74) *Attorney, Agent, or Firm*—Jones, Tullar & Cooper, PC

(57) ABSTRACT

Apparatus and Methods are disclosed for determining the direction between a rotating magnetic field and alternating magnetic field sensors at a remote location. The curvature of a borehole drilling assembly between a rotating drill bit carrying a permanent magnet and sensors behind a drilling motor is measured to provide early indication of changes in drilling direction. A second application concerns measurement of the convergence and divergence and the skewness of two approximately parallel well bores to provide information for correcting the drilling direction to maintain parallelism. A third application measures the direction and distance to a point target to provide data for guiding drilling toward that target. The primary apparatus are an oriented, rotating permanent magnet and an oriented, three component alternating magnetic field sensor.

23 Claims, 15 Drawing Sheets

Top View

Side View

View Looking Down Sensor X Axis

View Looking Down Sensor Y Axis

Angle AwHCsxSn vs. AwR

RELATIVE DRILL BIT DIRECTION MEASUREMENT

This application claims the benefit of Provisional Application No. 60/330,963, filed Nov. 5, 2001, the disclosure of which is hereby incorporated herein by reference.

FIELD OF THE INVENTION

The present invention relates, in general, to measurement while drilling (MWD) methods and apparatus, and more particularly to methods and apparatus for relative drilling direction measurement using a drill stem carrying a rotating magnet drill head.

BACKGROUND OF THE INVENTION

A typical drill stem, of the type which may be used in drilling boreholes such as wells for oil or gas exploration or production, or boreholes for the installation of cables and pipelines, in addition to many other purposes, carries at its lower end a drill head which includes a motor-driven rotary drill bit. Such drill bits are mounted on an angled drill bit shaft, or bent sub, which is driven by a motor under the control of a drilling operator at the earth's surface. The longitudinal axis of the bent sub is typically set at a small angle; for example, three-fourths of a degree, with respect to the axis of the drive motor and drill stem to allow directional drilling. The drive motor is typically mounted to the lower end of, and is coaxial with, a nonmagnetic section of the drill stem in which well survey electronics are located for measurement of well direction and location during drilling. Such drills are typically operated in one of two modes; a sliding mode or a rotary mode. In the sliding mode, the drill motor is activated to cause the drill bit to rotate while the rotational angle of the drill stem is held steady, and thus does not rotate. Since the axis of the bent sub, or drill bit shaft, is at a slight angle with respect to the axis of the drill stem and the drill motor, rotation of the bit causes the borehole to be drilled at the angle of, and in the direction of, the angle of the bent sub with respect to the drill stem axis, and this causes the borehole to change direction. The direction of the bent sub is controlled by the angular position of the drill stem and manifests itself by changing the down hole drilling direction by a small amount.

In the rotary mode of drilling, the drill stem is rotated as the down hole motor is powered to give the drill bit a compound rotation i.e. a component due to drill stem rotation and a component from the motor. This produces a continuous precession of the bent sub around the axis of the drill stem and causes the borehole to be drilled with a slight helicity. The average drilling is in the direction of the drill stem axis and with the diameter of the borehole being slightly larger than the diameter of the drill stem.

To achieve accurate directional control of the drilling, the drill operator needs to know with precision the borehole curvature being achieved. However, the measurement while drilling (MWD) equipment typically is located in a drill stem section above the drive motor, about 15 meters behind the drill bit. This means that if standard MWD equipment is relied on for the measurement of the borehole inclination and azimuth, the drill system will have advanced 15 meters before any measurement of a change in borehole direction can be obtained. In many applications, such as in the drilling of intersecting wells or in the drilling of closely spaced parallel wells such as those used in steam assisted gravity drainage (SAGD) wells, where parallel wells are spaced, for example, by approximately 5 meters over a kilometer of length, the problems of accurate directional measurement and drilling control are recurring and very serious.

In current practice, there are several systems used for overcoming this delay in the measurement of borehole inclination, but none for borehole azimuth. Typically, accelerometers and transmitters are located at or near the drill bit, and these transmit data past the motor to the MWD equipment, using either acoustic or electromagnetic transmission signals. However, these systems have serious problems, since such communication links are unreliable and the drilling must be stopped to measure the drill bit inclination. Such stoppages not only delay the drilling, but can result in the drill stem sticking in the borehole.

The current practice of drilling steam assisted gravity drainage (SAGD) well pairs is based upon a system disclosed in U.S. Pat. No. 5,485,089 and IADC/SPE paper 27466 which allows precise location determination of the MWD sensor package relative to a reference point approximately opposite the MWD package in a reference well. However, this method gives no information about the current relative drilling direction, i.e., whether the current drilling path is parallel to the reference well. It is only after drilling has proceeded to far beyond the point where the current measurement is being made that this evaluation can be carried out.

U.S. Pat. No. 5,589,775, which discloses a method of utilizing a drill bit with a rotating magnet to measure the azimuthal direction to an adjacent parallel wellbore, complements the present invention for obtaining a relative direction determination to a remote point. However, to produce parallel well pairs, knowledge of the current relative drilling direction relative to the direction of the reference well is very important, and there is a serious need to do this better than has previously been possible.

Similar concerns arise when it is necessary to drill precisely to a predetermined, distant point. Present practice is based upon determining the coordinates of the present drill bit location and those of the target and adjusting the drilling as it proceeds. Until recently these coordinates were determined by integrating a large ensemble of survey measurements from a surface location to the drill bit in conjunction with land surveys, with an ensemble of survey measurements to the target location. Recent developments have focused on making in situ determination of the apparent target location relative to the current drill bit location (A. G. Nekut, A. F. Kuckes and R. P. Pitzer, Rotating Magnet Ranging—a new drilling guidance technology, $8^{th}$ One Day Conference on Horizontal Well Technology, Canadian Sections SPE/Petroleum Society, Nov. 7, 2001).

U.S. Pat. No. 5,258,755 discloses a method for determining relative drilling direction utilizing a drill bit with a rotating magnet in conjunction with an axial electromagnet as part of the drilling assembly. While the physical principles of the method are sound, the encumbrance associated with incorporating an electromagnet into a drilling assembly has inhibited its development.

SUMMARY OF THE INVENTION

The present invention overcomes the problems of previous approaches to directional drilling control by providing an in situ determination of relative direction from a current drilling direction to a target.

One embodiment of the present invention is directed toward a method for measuring borehole curvature near a drill bit by measuring relative borehole direction at the drill bit during drilling of a borehole with respect to the direction of the axis of an MWD sensor package usually located approximately 15 meters behind the drill bit. An MWD package typically includes magnetometers for measuring the three vector components and includes inclinometers for measuring the three vector components of the earth's gravity. The measurement of direction is accomplished by mounting a permanent magnet on the drill bit for rotation, with the magnetic axis of the magnet lying in a plane perpendicular to the axis of rotation of the drill bit, and by providing alternating magnetic field sensors in a nonmagnetic section of the drill stem above the drive motor. These A.C. sensors, which may be incorporated into the conventional MWD equipment, detect and measure the x, y and z vector components of the alternating magnetic field produced by the rotating permanent magnet when the bit is driven by the bit motor. If the shaft connecting the drill bit to the motor is straight, i.e., coaxial with the axis of the motor and drill stem, the permanent magnet will be in a plane perpendicular to the axis of the drill stem, and would produce a uniform magnetic field in an x y plane perpendicular to the axis of the drill stem at the location of the sensor magnetometer. There would be no z axis field in this situation. It will be understood that since the drill bit is typically carried on a shaft emanating from a bent motor housing, as discussed above, the initial field produced by the permanent magnet normally is at a known angle with respect to the lower end of the motor by the amount of the bent motor housing angle. In accordance with this invention, this initial field is readily subtracted from measured values, so that the "effective" z axis field component is zero for some discussion purposes.

In the rotating mode of operation, the drill bit is rotated by the downhole motor, to which is attached the permanent magnet, so that the drill bit and motor rotate with respect to the drill stem and the MWD package to which they are attached, and the drill stem is also rotated. This causes the borehole to be drilled in the axial direction of the drill stem. In the sliding mode, the drill stem orientation is held fixed and the drill bit is rotated, causing the drill to advance at an angle with respect to the axis of the drill stem to cause the borehole to change direction. The sliding mode produces borehole curvature and produces a bend in the drive motor and drill stem, causing the angle of the plane of the permanent magnet to change with respect to the axis of the MWD sensor in the drill stem. This change in magnetic field direction produces a z vector component in the rotating magnetic field at the sensor, and this z component is a measure of the amount of the bend and thus of the change in the borehole direction.

In use, therefore, when a driller starts a drilling operation in the sliding mode, the drill stem, the motor and the drive shaft will start to bend as the bit takes hold. Typically, this produces a change in the direction of the borehole of anywhere from approximately 3 to 15 degrees after 30 meters of drilling, and this causes the direction of the axis of rotation of the permanent magnet to shift with respect to the axis of the drill stem at the MWD sensor equipment. This change can be accurately measured by the amplitude of the alternating z component of the magnetic field at the MWD sensors, and provides a direct measurement of changes in the borehole direction. This bending can be measured with great sensitivity, because the z component is essentially a null measurement. It is self-calibrating, since when there is no bending, there is effectively no signal. When there is a bend, it is only necessary to measure the amplitude and phase of the z component of the field relative to the x and y components to get a direct measurement of the magnitude and direction of the borehole bend relative to the sensing magnetometers.

Since the rotating magnet generates a rotating field which manifests itself as alternating magnetic field components at the sensors, phase averaging and phase locked loops can been used to extract very small signals. This overcomes the errors which might be caused by the intrinsic vibration of the drill stem during drilling and the consequent interaction of the magnetometers with the earth's magnetic field. Tests indicate that the effect of background fields does not prevent accurate measurement of inclination and direction in accordance with the present invention.

In a second embodiment of the invention, the sensors are mounted in an existing borehole for measurement of relative bit inclination and azimuth in an adjacent borehole as it is being drilled. For example, in the case where parallel wells are to be drilled, as in SAGD drilling, the drill operator needs to know with great accuracy the relative direction of the well being drilled with respect to an existing well with a casing. It is not only necessary to know that the separation between the wells is within tolerances, but just as important to the driller is knowing whether the current direction of drilling with respect to the existing well is correct, for if the direction is not known, there is a risk that the required separation will be lost. The separation is determined by measuring the direction of drilling as the drilling progresses and mathematically modeling the direction of the drilled well with respect to the reference well. In accordance with this embodiment, parallel drilling is accomplished by placing a stationary sensor, in an existing, or reference well. A permanent magnet is mounted on the drill bit in the well being drilled and as the drill bit passes the stationary sensor, the magnetic field component in the z direction can be used to ascertain the degree to which the new borehole is converging or diverging with respect to the reference well and also the skewness angle of the two wells.

In a third embodiment of the invention the method is applied to the problem of drilling guidance for a borehole which is to precisely intersect a distant point target. At the outset, where the method becomes an operable, the target and current depth of drilling locations may have an uncertainty in their relative locations of 10 meters or more if the points are far from their surface entry points. In this case a rotating magnet is again fixed to the drill bit together with a standard MWD orientation package in the drilling assembly, as described above. An instrument package, which includes 3-component alternating magnetic field sensors and orientation sensors using for example the Earth's magnetic field and Gravity direction together with means for transmitting data to the surface is placed at or near a target point. The amplitude and phase of the alternating magnetic field component for the current direction of drilling, relative to the alternating magnetic field components perpendicular to this direction, are used to determine the direction of drilling relative to that of a straight line connecting the target location and the drill bit location.

BRIEF DESCRIPTION OF THE DRAWINGS

The foregoing, and additional objects, features and advantages of the present invention will become apparent to those of skill in the art from the following description of preferred embodiments thereof, taken in conjunction with the accompanying drawings, in which.

DETAILED DESCRIPTION OF PREFERRED EMBODIMENTS

Figure 1:
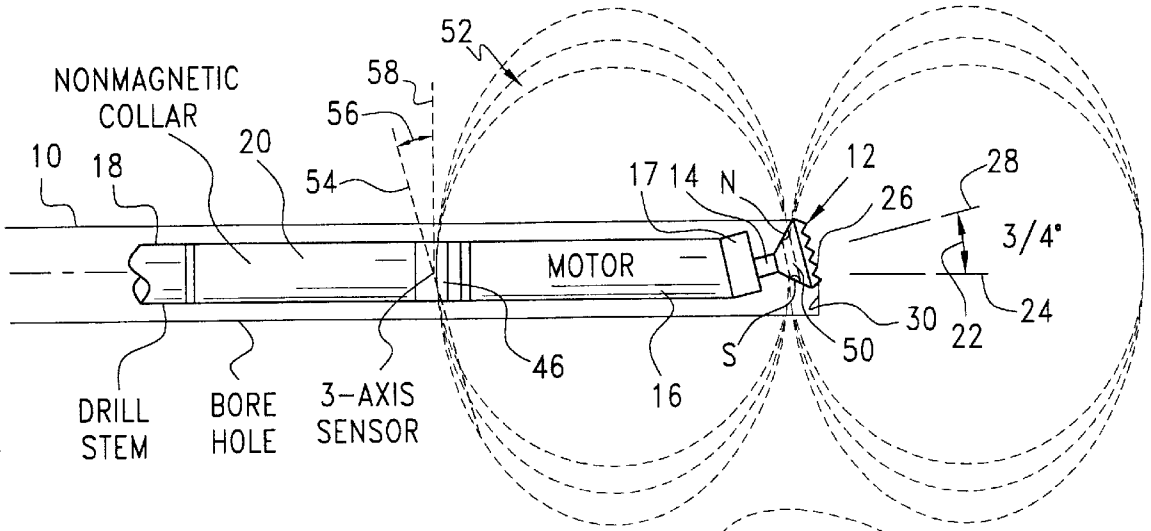
FIG. 1 is a diagrammatic illustration of a borehole measurement apparatus in accordance with the present invention.

Turning now to a more detailed consideration of the present invention, there is illustrated in FIG. 1 a borehole 10 being drilled by a drill bit 12 secured by way of a shaft 14 to a drive motor 16, by way of a bent motor housing and universal joint 17. The motor 16 is secured to the end of a drill stem 18 by a nonmagnetic collar 20, in conventional manner. As is known, the drive shaft 14 preferably is connected at an angle 22 with respect to the axis 24 of the motor 16, and this angle may be 0.75 degrees to 2.0 degrees or even larger, depending upon the borehole curvature desired. The bent motor housing 17 positions the face 26 of the drill bit 12 at an angle with respect to axis 24 so that when the motor 16 is driven, the drill bit tends to drill the borehole in the direction of the axis 28 of shaft 14.

In operation, the drill stem 18 may be rotated continuously by the drilling operator at the earth's surface to cause the shaft 14 to precess about the drill stem axis 24, causing the axis of shaft 14 to trace a cone about axis 24. When the drill bit 12 is driven by motor 16 at the same time as the drill stem is rotated, the drill face 26 precesses around the face 30 of the borehole 10 as the drilling occurs, and the borehole, on average, progresses in a straight line, along the axis 24. This operation is known in the art as the "rotating" mode of drilling.

The drill may also be operated in a "sliding" mode, wherein the drill stem 18 is stopped at a desired angular location, which is measured by an MWD and alternating magnetic field sensor package 46 located in the nonmagnetic collar 20. The drill stem is then held steady and the drill bit 12 is rotated by motor 16 alone. This causes the borehole 10 to be drilled in the direction of the bent motor housing with respect to axis 24, thereby changing the direction of the borehole, in the manner illustrated in FIG. 2. In this mode, the borehole 10 bends, as generally illustrated at region 40, causing the borehole to move generally in the direction of axis 42, at an angle 44 with respect to the original borehole axis 24. The angle 44 may be, for example, a few degrees, but the scale is exaggerated in the figures for purposes of illustration.

A drill stem of the type illustrated herein conventionally carries measurement while drilling (MWD) equipment in the nonmagnetic collar 20 for measuring the parameters of the drilling operation, transmitting measured data to the surface and perhaps receiving control signals from the surface to operate down hole equipment. Typically, industry standard MWD equipment 46 carries suitable dc magnetic field sensors which may be 3-axis magnetometer sensors, for detecting the earth's magnetic field, and 3 axis accelerometers or inclinometers to sense the earth's gravity direction for use in determining the direction and orientation of the drill stem. Typically, the the dc field sensors in the MWD equipment are approximately 15 meters from the drill head 12 so that, as diagrammatically illustrated in FIG. 2, the bending of the borehole during sliding mode drilling does not affect the sensors until the drilling has progressed about 15 meters. In accordance with the present invention, the typical MWD equipment is modified to incorporate 3-axis alternating magnetic field sensors for detecting the vector components of an alternating magnetic field generated by a rotating magnetic field source (to be described). The alternating field sensors preferably consist of second amplified outputs from the d.c. field magnetometers or very precise digitization of the magnetometer outputs; alternatively, a second 3-axis set of a.c. field sensors may be provided.

To provide an early detection of changes in the axial direction of the borehole 10, in accordance with a preferred embodiment of the invention, a permanent magnet 50 is located on the drill head 12. The magnet is elongated to provide a north pole (N) on one side of the drill head and a south pole (S) on the side diametrically opposite thereto, with the north-south axis of the permanent magnet 50 lying in a plane which is perpendicular to the axis 28 of the drill head 12 and drive shaft 14. The permanent magnet 50 produces a magnetic field, generally indicated at 52, a portion of which passes through the sensor package 46 for detection. The field 52 at the location of the sensor lies in a plane 54 which is defined by the instantaneous axis of the permanent magnet 50 and the location of the sensors 46. In a straight borehole as shown in FIG. 1, the field line angle 56 is a function of the bent motor housing angle 22. This is a constant angle and, in accordance with the invention, is either ignored or canceled in the sensor package 46 so that the measured magnetic field 52 at sensor package 46 has x-y components lying in plane 58 and has a z component lying along axis 24 which is nulled to have a value of zero in a straight borehole.

Figure 2:
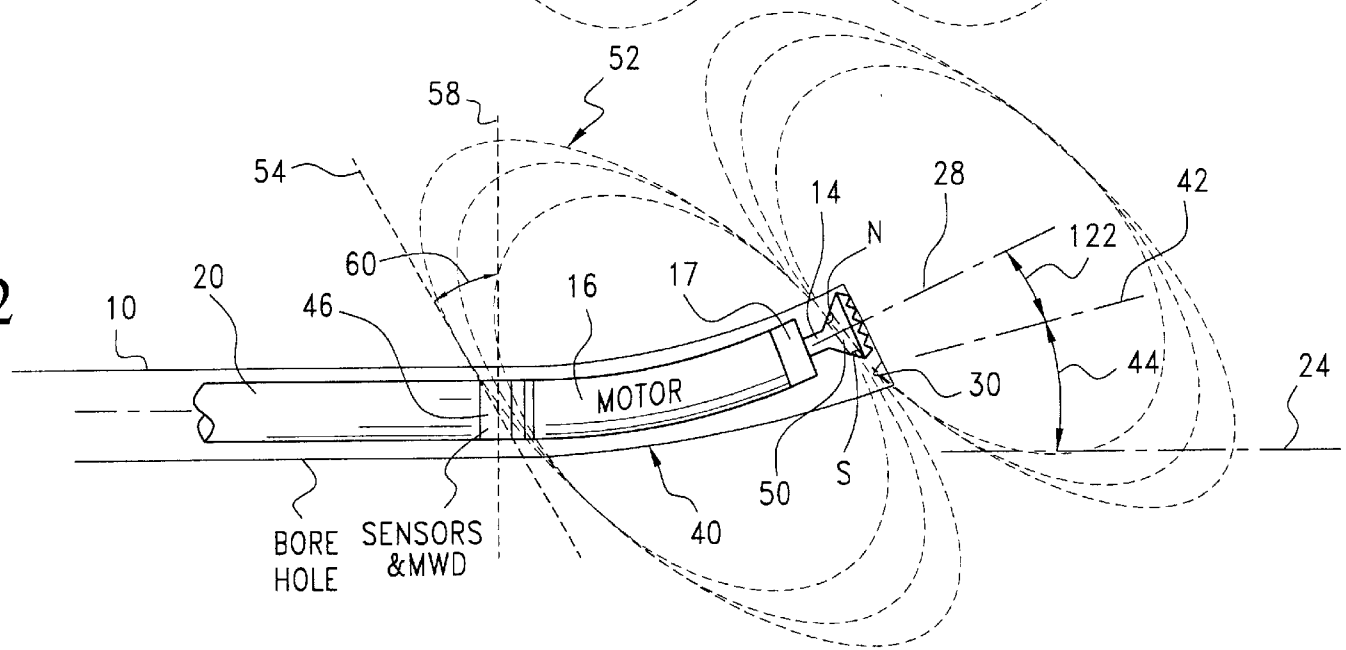
FIG. 2 is an illustration of the first embodiment of the invention located in a borehole being drilled whose curvature near the drill bit is to be determined.

Rotation of the drill head 12 causes the magnetic field 52 to rotate with the permanent magnet 50, and this rotating field is detected by the ac field portion of sensor package 46 with a high degree of sensitivity. When the borehole is curved in the manner illustrated at 40 in FIG. 2, the direction of the magnetic field 52, and thus the angle of plane 54, at the location of sensor 46 will change in response to the borehole curvature, which changes the angle 44 of the rotating magnet axis with respect to axis 24. The plane 54 of field 52 then intersects sensor package 46 at a new angle 60 (FIG. 2). This change in the angle of the field 52 results in little fractional change in the x-y components of the magnetic field in plane 58, but results in an important change in the z-component of the field lying along axis 24. This change in the z component and its phase relationship to the x and y components provides a direct measure of magnitude and direction of the angle 44.

Figure 3:
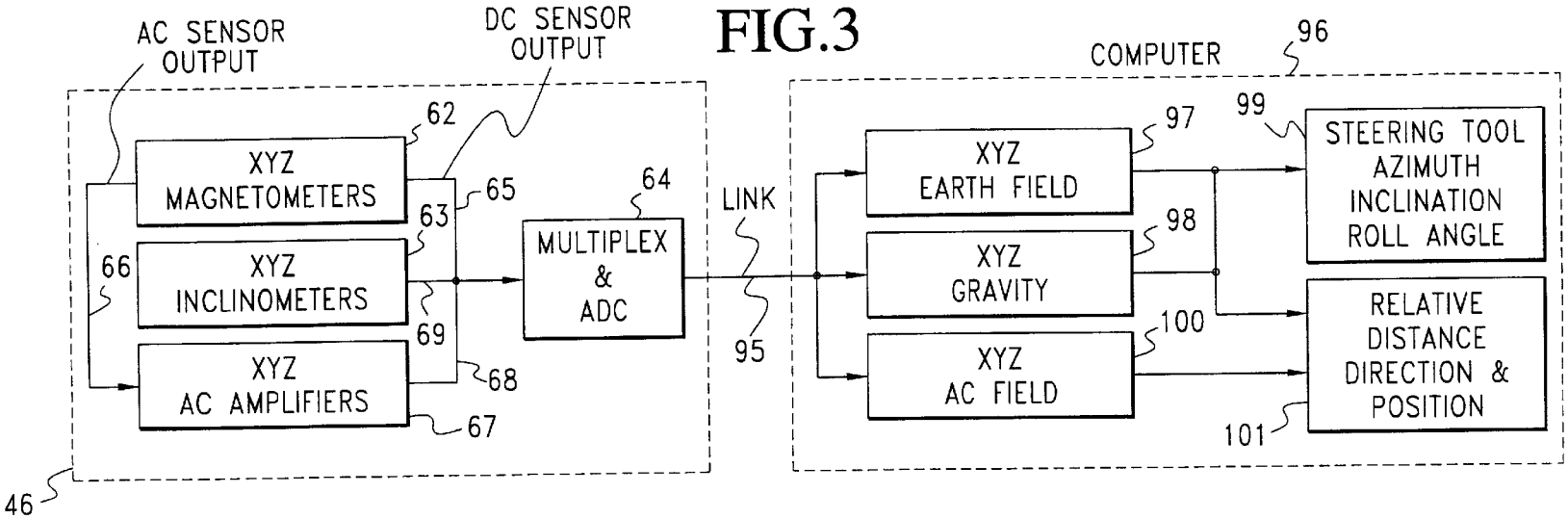
FIG. 3 is a diagrammatic illustration of the sensor circuitry for measuring magnetic fields.

FIG. 3 illustrates in diagrammatic form the downhole MWD sensor package 46, and its included xyz magnetometers 62 and xyz inclinometers 63. The magnetometers 62 preferably sense both the Earth's dc magnetic field and the superimposed ac magnetic field 52 produced by the rotating magnet 50. The measured dc field is supplied to a multiplexer 64 by way of sensor output 65, while the measured ac field is supplied by way of ac sensor output 66 to amplifiers 67, the output of which is then supplied to the multiplexer 64 by way of out put 68. The output of the inclinometers 63 is supplied to the multiplexer by way of output 69. As noted above, the ac magnetic field may be detected by separate x, y and z field sensors, with their outputs connected to the multiplexer; however, the illustrated sensor is preferred.

Figure 4:
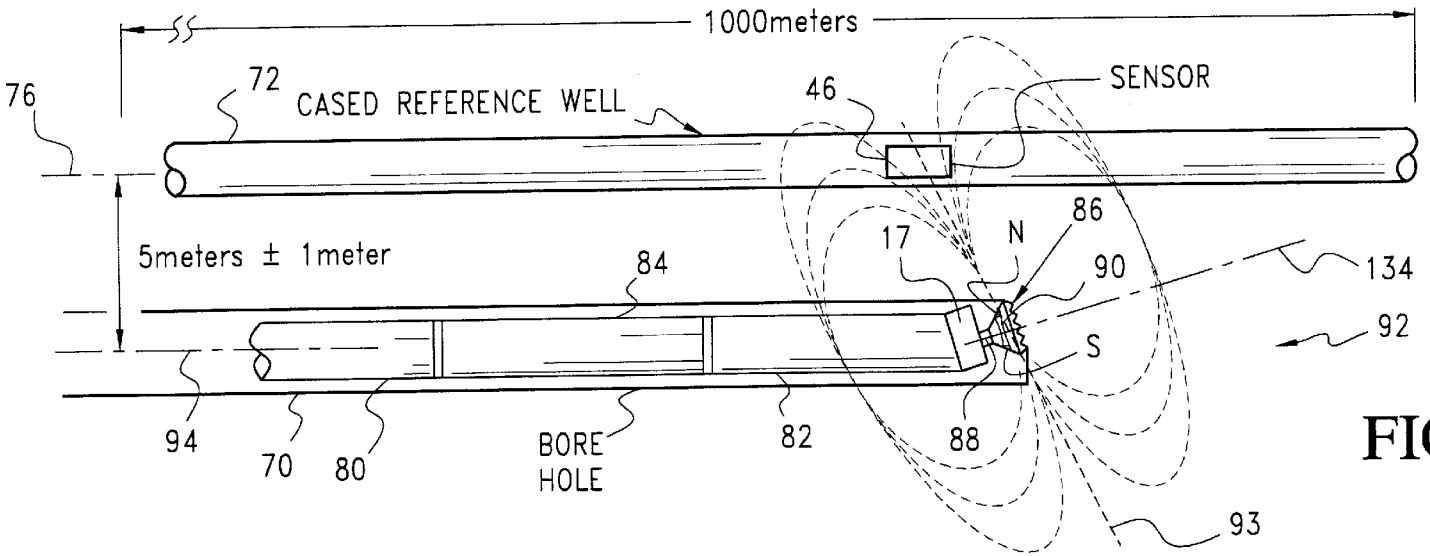
FIG. 4 is a diagrammatic illustration of a second embodiment of the invention wherein parallel wells are drilled.

Turning now to FIG. 4, a second embodiment of the invention is illustrated wherein a borehole 70 is to be drilled in a specified direction with respect to a cased reference well 72. Although other applications will be apparent, this embodiment will be described with respect to the drilling of a pair of parallel wells such as might be used in steam assisted gravity drainage (SAGD) systems. In such systems, the second borehole 70 is to be drilled so as to remain parallel to an existing, or reference well 72. This parallelism typically must be maintained for a borehole distance of 1000 meters with a spacing of 5 meters, +/−1 meter. As described above, in this environment it is extremely important that the driller know whether the direction of drilling is correct with respect to the existing well so that the required separation can be maintained. In this embodiment the sensor package 46 incorporating a 3-axis alternating field magnetometer and a 3-axis inclinometer is located in the reference well 72, with the z-axis of each of the sensors lying along the axis 76 of the well 72 and with the orientation of the x-y plane of the sensors in package 46 being perpendicular to that axis and being determined by the measurement of the gravity direction by the inclinometers. In this application Earth magnetic field sensors are usually of little use since the sensor package is deployed inside steel casing.

A drill stem 80 is located in borehole 70 and carries a drilling motor 82 connected to the drill stem 80 by a nonmagnetic collar 84. The drilling motor 82 carries a drill bit 86 which is driven by the motor through the drive shaft, or bent sub, 88. As described above, the drill bit 86 carries a permanent magnet 90 having a north pole on one surface of the drill bit 86 and a south pole on a diametrically opposite surface. The permanent magnet produces a magnetic field generally indicated at 92. As in the previous embodiment, the field 92 rotates with the drill bit 86 and the direction of the borehole is controlled by the operator at the earth's surface, with drilling being done in the rotating mode or the sliding mode in response to measurements of the magnetic field 92 at sensor 46. Although the plane 93 in which the permanent magnet rotates is shown as being angled with respect to the axis 94 of the motor 82 because of the angle of the bent sub, it will be understood that this angle is compensated for in making the calculations described herein.

In operation, as the drill bit 86 passes by the sensor package 46, the angle of the borehole 70 being drilled with respect to axis 76 is determined by measurements of the alternating magnetic field 92. If the wells are perfectly parallel, the plane 93 will be perpendicular to axis 76 (after compensation) and there will be a point, when the drill bit is directly opposite the sensors, where the z component of the field 92 at the sensors passes sharply through zero. The phase of this field, with respect to the x and y components, suddenly changes by 180 degrees at this time. In addition, the z component of the field will have two identical peaks, one before and one after the passby point, separated by a depth difference equal to the well separation distance. If the wells are converging or diverging but coplanar, the z-component of the magnetic field will still exhibit a point where the z field component goes sharply to zero; however, the amplitude of the two field peaks will differ, in amplitude from which the amount and sign of such convergence or divergence can be determined. If the two boreholes are not exactly coplanar but are slightly skewed, the z component of the field will have a small quadrature component at the point where it is almost zero. The amplitude of this quadrature field component together the magnitude of peak fields on either side is a direct measurement of the skewness angle of the wells.

The outputs from the sensor package 46 are supplied by way of the multiplexer and an analog to digital converter for transmission through a suitable communication link 95 to a computer 96 located at the Earth's surface. The dc sensor signals are decoded at 97 and the gravity signals at 98 and are supplied to the computer section 99 for calculation of the orientation of the sensor package 46. These signals, as well as the ac sensor signals decoded at 100, are supplied to computer section 101 for calculation of the relative distance and direction from the magnetic field source to the sensor package, and for calculation of the relative positions of these components, as will be described.

Figure 5:
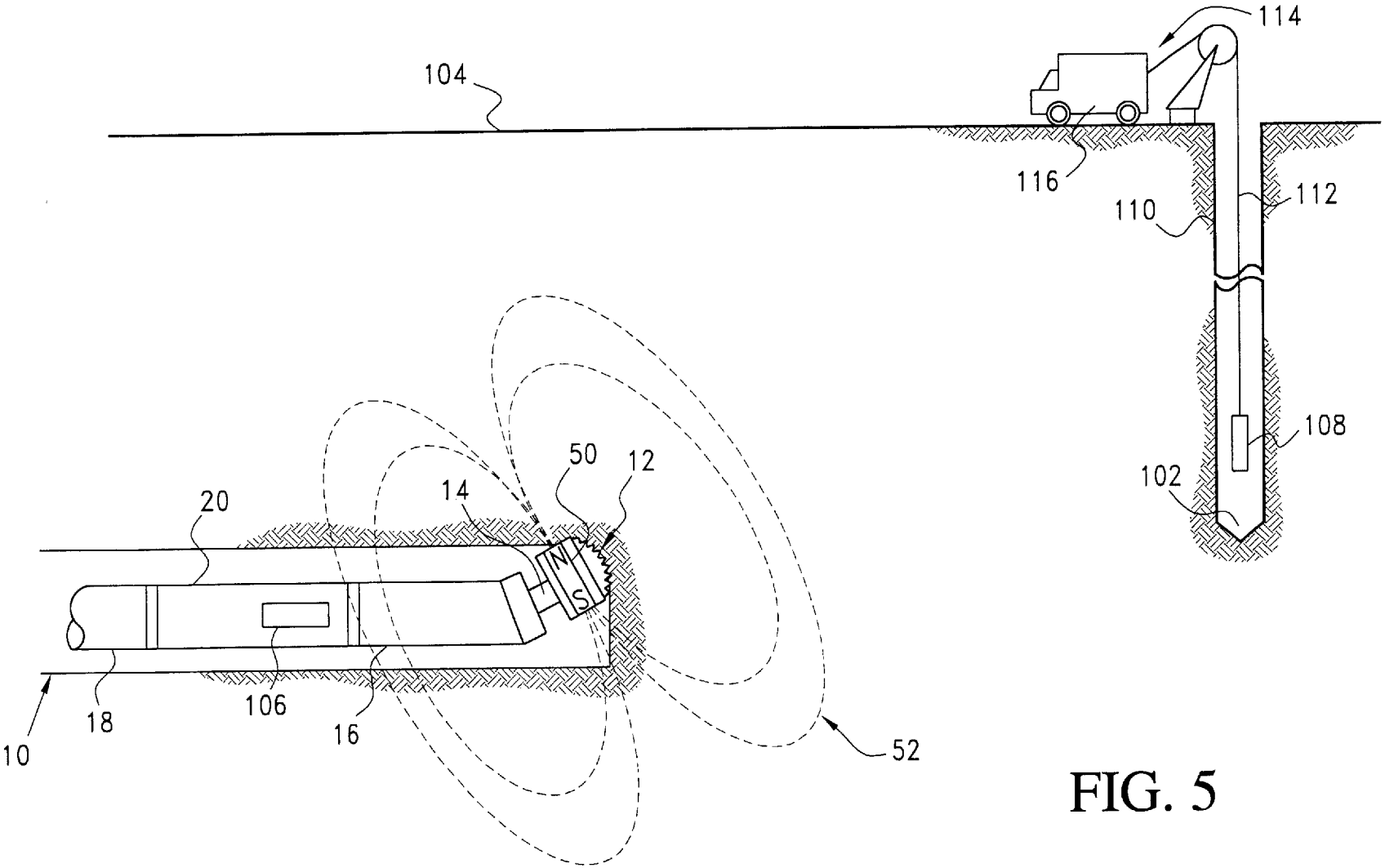
FIG. 5 is a diagrammatic illustration of a third embodiment of the invention wherein drilling is to be guided toward a distant point.

A third embodiment of the invention is shown in FIG. 5. In this case, the borehole 10 is being drilled directionally with the objective of intersecting a distant point 102 which may be under the Earth's surface 104, as shown. Borehole 10 is drilled using a drill assembly such as that illustrated in FIG. 1, having conventional survey guidance provided by a standard MWD package 106 which includes a 3-component Earth magnetic field sensor and a 3-component gravity sensor. FIG. 5 shows the drilling to have progressed to a point which may be approximately 50 meters from the distant point 102, at which time the methods disclosed herein become operative. At the outset, the uncertainty of the borehole location relative to the target may be 10 meters or more, but the objective is to continually adjust the direction of drilling so that borehole 10 homes in onto the target location 102 with a precision which may be less than a meter. Near the target location 102 is a sensor package 108 which incorporates a 3-component alternating field magnetometer together with a 3-component Earth field magnetometer and a 3-component gravity sensor. The sensor package 108 is deployed at the target location 102 or at a point close by. For the case illustrated in FIG. 5, the target location 102 is at a specific depth in a borehole 110. The sensor package is shown deployed on a wireline 112 positioned by a winch 114 at the surface. Data generated by the instrument package 108 are transmitted on the wireline to a computer in, for example, a truck 116 which is networked to a second computer (not shown) receiving the MWD data from the instrument package 106.

Figure 6A:
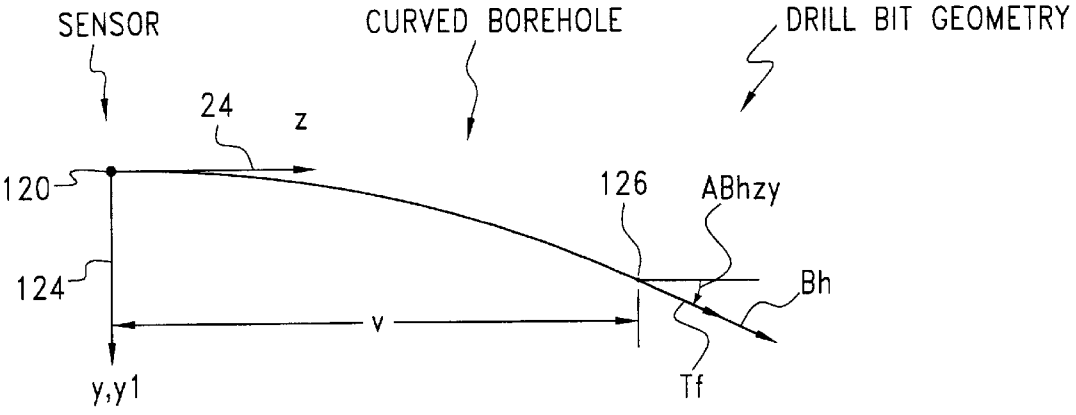
FIGS. 6*a* and 6*b* diagrammatically illustrate a top view and a side view of the relevant directions used in the mathematical formulation for the first embodiment of FIG. 2.
Figure 6B:
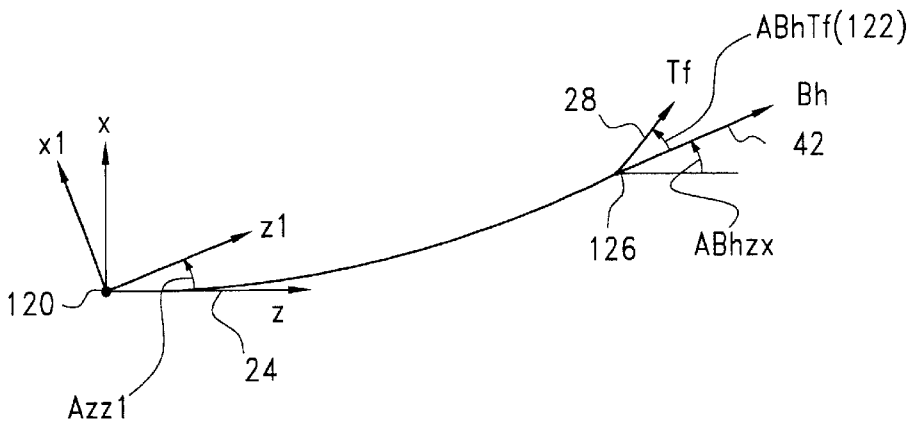

The essential physical and mathematical relationships governing the first embodiment of the invention can be discussed from FIGS. 6*a* and 6*b* which schematically illustrate the relevant geometry of the device of FIG. 2. A sensor site 120 illustrates where the 3-component xyz alternating field and MWD sensor package 46 is located and fixed to the non-magnetic collar 20. The z direction is the axis 24 of the non-magnetic collar at the sensor site. The non-magnetic collar is rigidly fixed to the motor housing 16, and both follow the curvature of the borehole, and are fastened to the bent section of the motor housing 17, from which the drill bit shaft 14 emanates. The angle 122 between axis 42, which is perpendicular to the distal end 30 of the borehole and the axis 28 of the drill bit shaft 14 which defines the tool face, is fixed by the bent section of the motor housing 17; this angle will be referred to as ABhTf, the angle from the borehole to the tool face. The plane of this bend with respect to the overall motor housing 16 is precisely known and the direction normal to this plane defines the y axis 124 shown. If these definitions of the z and y axes are not the actual electrical axes of the sensors in sensor package 46, their outputs are mathematically rotated so that that is the case.

The projection of the distal end of the borehole onto the zx and zy planes defines the two "projected" angles of interest, ABhzx and ABhzy. The following discussions are restricted to small angles, i.e., angles where the value of the cosine can be taken as 1 and the value of sine can be taken as equal to the angle (expressed in radians). Then, if the orientation of the drill stem 18 is held fixed and the motor 16 is powered, for example by fluid flowing through it, the bit 12 rotates at a frequency of w radians/sec. The dominant terms for the fieldcomponents Hx, Hy, and Hz are, writing the product of w*t as wt, $$Hx=H^*\cos(wt)$$

$$Hy=-H^*\sin(wt)$$

$$Hz=H^*(((ABhzx/2)+2^*ABhTf)^*\cos(w^*t)+(ABhzy/2)^*\sin(w^*t))$$

$$H=M/(4^*pi^*r\hat{}3) \qquad \text{(Eq. 1)}$$

where M is the magnetic moment of the magnet and r is the distance between the sensors and the site 126 rotating magnet 50. To eliminate the effect of the bent motor housing, i.e., the term proportional to ABhTf, several means are available. A good one is to mathematically rotate the x y z coordinate axes about the y axis to x1 y1 z1 as shown in FIG. 6*b* by an angle Azz1=−2*ABhTf. The dominant values of the new components Hx1, Hy1, Hz1 in this coordinate system are:

$$Hx1=H^*\cos(wt)$$

$$Hy1=-H^*\sin(wt)$$

$$Hz1=H^*(((ABhzx/2)^*\cos(w^*t)+(ABhzy/2)^*\sin(w^*t)) \qquad \text{(Eq. 2)}$$

Thus, the effect of the bent motor housing has been eliminated. The efficacy of the coordinate rotations performed in converting the electrical outputs of the sensors to the relationships of Eq. 2 can be tested and the rotation matrices "tweaked" by noting that in a section of the borehole known to be straight, Hz1 should vanish.

The effect of drilling in the rotating mode, i.e., rotating the drill stem at a speed of W radians per second, will have the effect of bending the drill string back and forth so that the angles ABhzx and ABhzy will vary:

$$ABhzx=ABhBd^*\cos(W^*t+Ph)$$

$$ABhzy=-AbhBd^*\sin(W^*t+Ph) \qquad \text{(Eq. 3)}$$

and $$Hz1=(H^*ABhBd/2)^*\cos((W+w)t+Ph)$$

Ph is an offset phase of the drill stem rotation angle from the origin of its measurement. The angle ABhBd is the borehole bend angle in the plane of the bend. The minus sign in Eq. 3 for Abhzy comes from the fact that, with respect to the drill stem, the Earth appears to be rotating in a negative direction, i.e., counterclockwise looking down.

To actually compute the angles ABhzx and ABhzx from a digital data stream, i.e. from a time sequence of Hx1, Hy1 and Hz1 values, requires some mathematical manipulation since signal averaging over a significant number of rotational cycles of the drill bit is required. One way to consider the problem is in the context of making a digital "lock in amplifier". To demonstrate the principles, and one way of doing this, consider a digital data stream generated in the sliding mode of drilling. To use a lockin amplifier requires a reference which faithfully follows the necessary harmonic synchronism of the signal, in this case the rotation of the drill bit generating the alternating magnetic field. Since the drill bit rotational orientation speed is not known exactly, and varies slowly in time, some attention must be devoted to generating reference signals. A method of generating "sin (wt) and cos(wt)" reference signals is to use digital filtering hilbert transforms operations on the signals themselves. The programming language MATLAB provides the necessary built-in functions for doing this.

One starts with a sufficiently long digital record of the alternating magnetometer signals Hx1, Hy1 and Hz1. Hz1 contains the important information and has a much smaller amplitude than either Hx1 and Hy1. A reference phase angle of the rotating magnet wt will be generated from Hx1 and Hy1. The value of w; i.e., the drill bit rpm/(2*pi*60), is known approximately at the outset, from the motor specifications and the volume of fluid being pumped through it, to lie between 2*pi*f1 and 2*pi*f2. The first step is thus to digitally filter out all the frequencies from Hx1 and Hy1 which are very different from the known range of the rotational radian frequency w (this "w" is not to be confused with the borehole direction "w" used elsewhere in this disclosure).

To obtain the phase wt, the hilbert transform is used. The hilbert transform of a real data sequence which varies as A(t)*cos(w(t)*t+ph), where A(t) and w(t) vary slowly in time and ph is a constant, generates a complex sequence, the real part reproduces A(t)*cos(w(t)*t+ph) and the imaginary part is A(t)*sin(w(t)*t+ph). Thus, the real and imaginary parts of a hilbert transform make it possible to generate inphase and quadrature reference functions for a rotating source whose rotational frequency is changing slowly.

The following MATLAB lines of program do the required filtering and generation of a reference sequence:

```
[b a]=butter(4,[f1 f2]/Nyquist);

HxFilt=filtfilt(b,a, Hx1);

HilbTfHx=hilbert(Hxfilt);

wtx=atan 2(imag(HilbTfHx),real(HilbTfHx));

CsRefx=cos(wtx);

SnRefx=sin(wtx);

Hyfilt=filtfilt(b,a,Hy1);

HilbTfHy=hilbert(Hyfilt);

wty=atan 2(imag(HilbTfHy),real(HilbTfHy))+3*pi/2;

CsRefy=cos(wty);

SnRefy=sin(wty);

CsRef=(CsRefx+CsRefy)/2;

SnRef=(SnRefx+SnRefy)/2;
```

The first line of the above program uses the MATLAB butter function to generate arrays of coefficients b and a which define a 4 pole Butterworth band pass filter which passes frequencies between f1 and f2; i.e., the frequency range in which w/(2*pi) is expected to lie. Nyqist is the Nyquist frequency, which is one half the sampling frequency of the Hx1, Hy1, and Hz1 data sequences. HxFilt is the result of filtering Hx1 with the Butterworth filter coefficients b and a. The function filtfilt first passes the Hx1 sequence through a normal Butterworth filter, and this result is then passed through the filter a second time, in time reversed order, to yield HxFilt. This results in "double" the filtering and no phase shifts in the frequency components of HxFilt relative to Hx1. The Hilbert transform of HxFilt, i.e., HilbTfHx is the sequence of complex numbers generated by the function hilbert as explained above. The phase wtx of the rotating magnet, implicit in the Hx1, can be found by computing the 4 quadrant arc tangent of the real and imaginary parts of HilbTfHx using the atan2 function. Finally, CsRefx and SnRefx are cosine and sine reference functions derived from the Hx1 signal. The same procedure is used on the Hy1 signal to derive CsRefy and SnRefy. Finally, the reference sequences derived from Hx1 and Hy1 signals are averaged.

Hx1, Hy1, and Hz1 are then passed through the lockin amplifier using the in-phase and quadrature reference signals CsRef and SnRef to find H, ABhzx and ABhzy. The following program lines do this:

```
H=mean(CsRef.*Hx1+SnRef.*Hy1);

ABhzx=4*mean(CsRef.*Hz1);

ABhzy=4*mean(SnRef.*Hz1);
```

The first line of this sequence generates a signal averaged H from Hx1 and Hy1. The MATLAB symbol ".*" means multiplying the 2 sequences on either side of the symbol element by element to form a new sequence of the same length. Thus CsRef.*Hx1 effectively generates H*(cos(wt))^2, the mean value of which is H/2. Performing the corresponding operation on Hy1 also produces H/2. Multiplying Hz1 term by term by CsRef and taking the mean and multiplying by 4 and noting equation (1) gives the angle ABhzx. All the function routines referred to above are supplied by MATLAB.

A typical, modest borehole curvature is 3 degrees/30 meters of depth. A a convenient distance between the drill bit, where the rotating magnet is located, and the magnetometer is 15 meters. For such a bend ratio the magnitude of Hz1 to Hx1 (or Hy1) is about 0.013. Tests indicate that a measurement sensitivity of Hz/Hperp of about 0.002 can often be attained.

Figure 7A:
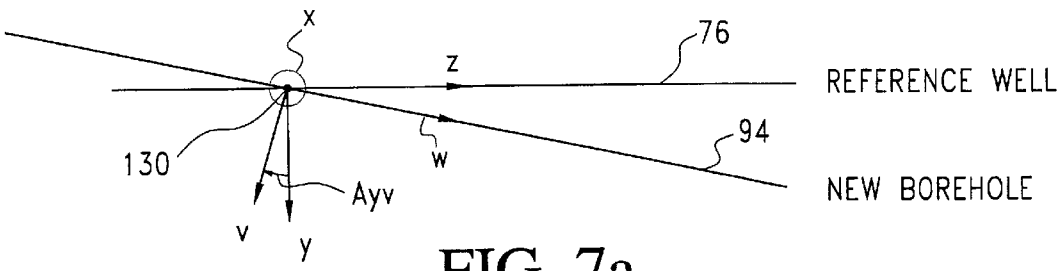
FIGS. 7*a* and 7*b* diagrammatically illustrate a top and a side view of the directions used in the mathematical formulation for the second embodiment of FIG. 4; relevant mathematical quantities.
Figure 7B:
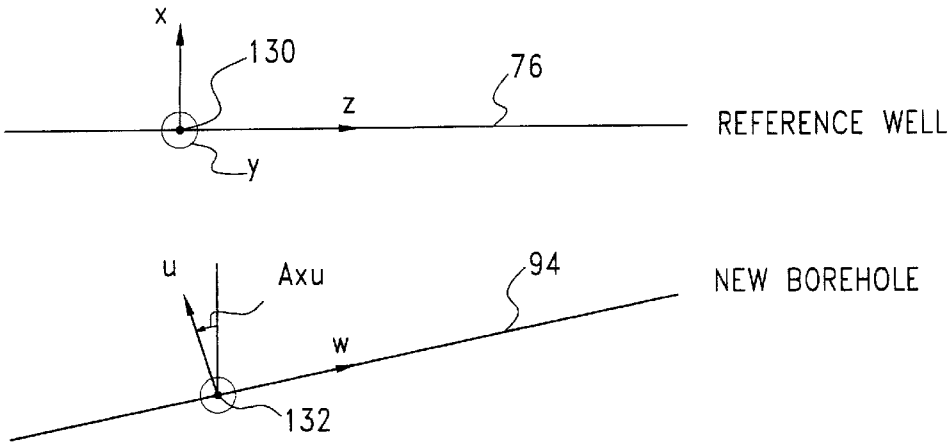

For the essential physical and mathematical relationships governing the second embodiment of the invention, whereby the relative direction of the two approximately parallel boreholes can be found, reference is made to FIGS. 7*a* and 7*b*, which complement FIG. 4. FIGS. 7*a* and 7*b* show a top view and a side view of the new borehole 70 being drilled and the reference well 72, the site 130 where the alternating field sensors 74 are located, together with the directions of the coordinate systems relative to the sensors and the site 132 of the rotating magnet 90 used in the analysis. The rotation axis 134 of the magnet wUv will be taken to coincide with the axial direction 94 of the borehole being drilled, omitting for the moment the corrective effects required for a bent motor housing. Mathematically the rotating magnetic field source 50 can be considered as the superposition of two independent, oscillating, linear magnetic dipoles perpendicular to each other and each perpendicular to the axis of rotation w. With these constraints the oscillator unit vector axes directions u and v can be chosen to suit the computation. The "inphase" and "quadrature" reference functions CsRef and SnRef serve to take time projections of the signals onto abstract "cosine" and "sine" directions associated with the phase of the rotating of the magnet.

As shown in FIG. 7, the vector u is chosen as being the direction defined by a line perpendicular to the borehole 70 being drilled and connecting to the sensor package, location 130 at the passby point. The unit vector vUv is perpendicular to w and u to form a right handed coordinate axes. The magnetic dipoles of the two sources are described by M*cos(wt)*uUv and M*sin(wt)*vUv, where M represents the magnetic moment of the magnet, wt is the product of rotational speed in radians per second and time reconned from an appropriate starting time. The x y and z coordinate axes are tied to the sensors at location 130 in the refence well. The z axis lies along the reference well, x is in the uw plane and y is perpendicular to xy, with x y and z forming a right handed system of axes. For the case of two approximately parallel wells, the analysis can be separated into two independent problems: first, that of determining the convergence/divergence of two coplanar boreholes, i.e., determining the angle Axu shown in FIG. 7*b*, and second, the problem of determining the skewness of the two boreholes; i.e., the angle Ayv as shown in FIG. 7*a*.

Figure 8:
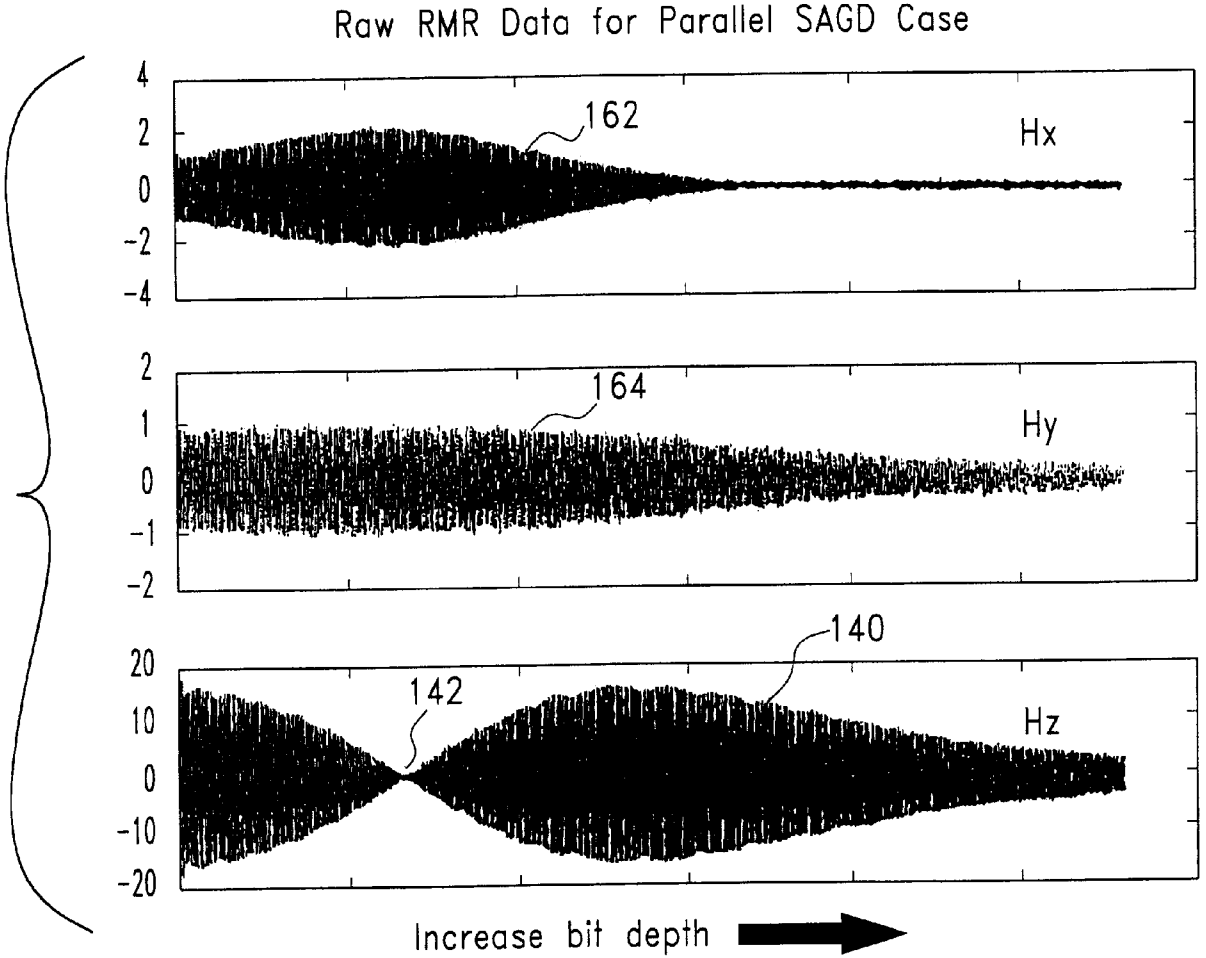
FIG. 8 illustrates typical data received during use of the system of FIG. 7 in a steam assisted gravity drainage well.

Consider first the case of two coplanar wells. A manifestation of any convergence or divergence of the wells can be found in the fact that the maximum value of the Hz data envelope 140, as shown in FIG. 8, before the passby point 142, where Hz goes to zero, is different from maximum value of that envelope after the passby. There is a direct relationship between the difference between in these maxima, their average value and the convergence/divergence angle Axu:

$$Axu=(1/3)*(Hz\mathrm{Max}\mathbf{2}-Hz\mathrm{Max}\mathbf{1})/(Hz\mathrm{Max}\mathbf{2}+Hz\mathrm{Max}\mathbf{1}) \quad \text{(Eq. 4)}$$

Where HzMax1 and HzMax2 are maximum values of Hz before and after the passby; i.e., at a measured depth in the new well equal to the passby depth +/− (well separation distance)/b 2. For the case of coplanarity, only the dipole oscillator in the u direction contributes to Hz and the time phase of Hz is that of the u oscillator. The field generated by the v oscillator is entirely perpendicular to this plane and thus generates no Hz. An important property of the Hz field component which the u oscillator generates is that it goes to zero at the passby point and changes sign, i.e., its phase changes by pi radians relative to that of the source. The sharpness of this zero crossing is evident in the data record shown in FIG. 8.

Figure 9:
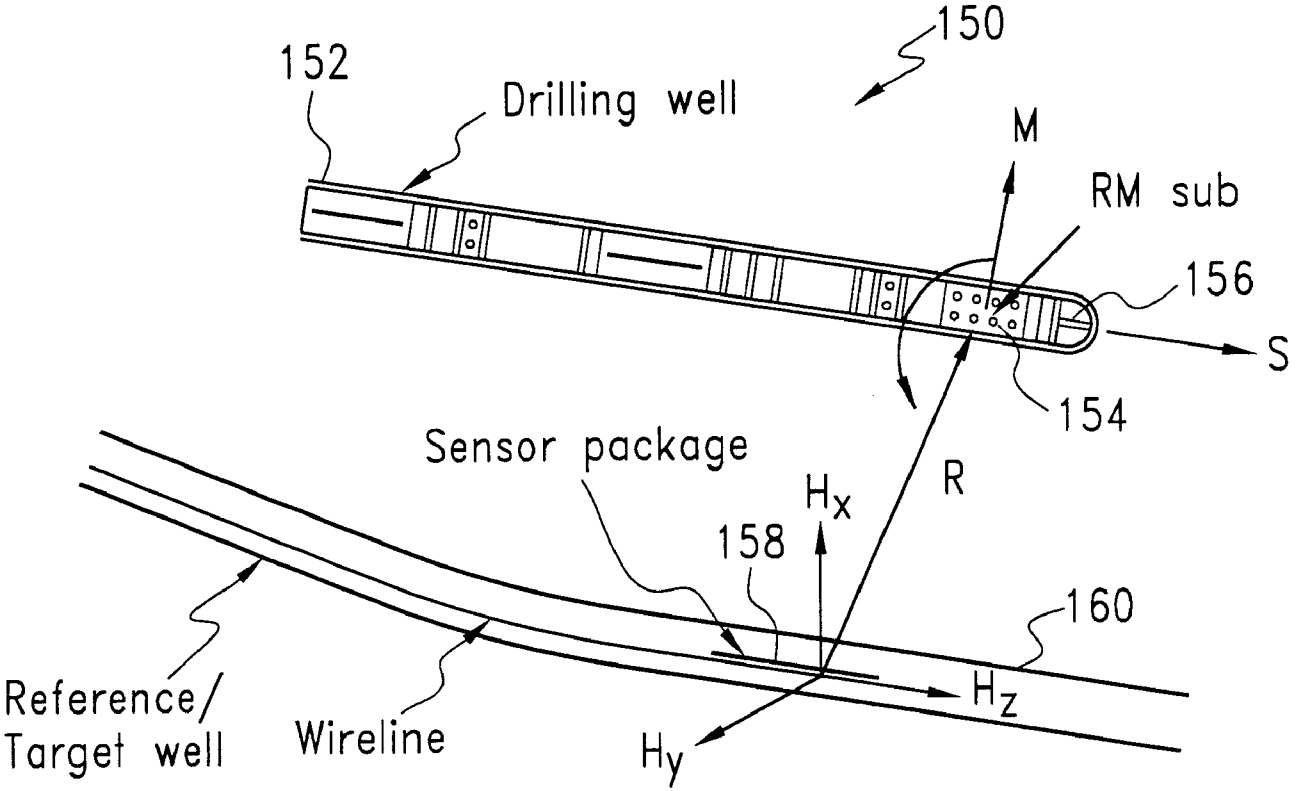
FIG. 9 is an illustration showing the borehole and apparatus configuration used in the tests of the second embodiment.

A test of the this method of determining the convergence/divergence of two approximately parallel wells was carried out in the course of evaluating the overall efficacy of using a rotating magnet source for drilling a SAGD well pair such as that discussed above with respect to FIG. 3 (A. G. Nekut, A. F. Kuckes and R. P. Pitzer, Rotating Magnet Ranging—a new drilling guidance technology, $8^{th}$ One Day Conference on Horizontal Well Technology, Canadian Sections SPE/Petroleum Society, Nov. 7, 2001). FIG. 9 shows at 150 the overall well geometry and configuration employed. In the drilling well 152, permanent magnets were housed in a short sub 154 inserted immediately behind the bit 156 with a total dipole moment of several hundred amp m^2. The sensor package 158 in the reference well 160, in this case in a lower producer well, included a three-component AC magnetometer to measure the three components of the time varying magnetic field (Hx, Hy, and Hz) generated by the rotating magnets. The analysis also used a 3-component accelerometer to measure gravity to determine the orientation of the sensor package.

Ranging data were acquired continuously over a drilling interval, usually the length of a single 9 meter joint of drillpipe. The sensor was repositioned after drilling each 9 meter joint of drill pipe to keep it adjacent to the next drilling interval.

FIG. 8 shows a typical data record while drilling ahead approximately 9 m in the injector. The amplitude 40 of the axial magnetic field component (Hz) goes sharply through a minimum 142 as the rotating magnet bit sub passes by the sensor. The distance between the two axial field amplitude maxima is equal to the separation between the injector and producer (the injector is 5+/−1 meters above the producer). Amplitude differences between the two maxima are a sensitive indicator for borehole convergence/divergence, as pointed out above. The transverse field component amplitudes (Hx and Hy) illustrated by envelopes 162 and 164 were much smaller than the axial amplitude due to the field attenuation through the double wall casing tubing string which consisted of a 7 inch production liner and 3 inch tubing inside of which the sensors were located. The separation distance between the peaks and the relative amplitudes and phases transverse components were used to determine the azimuthal position of the injector about the producer axis.

Each survey began with the sensor 158 approximately 4 meters ahead of the bit 156 so that sufficient data would be recorded and processing could begin 1–2 meters before the drilling had to be shut down for connection to the next drill stem segment. This allowed the ranging data to be in the drillers' hands at the same time or before the MWD survey, and also allowed time to pump the sensor 158 forward 9 m along the reference well in preparation for the next survey.

Figure 10:
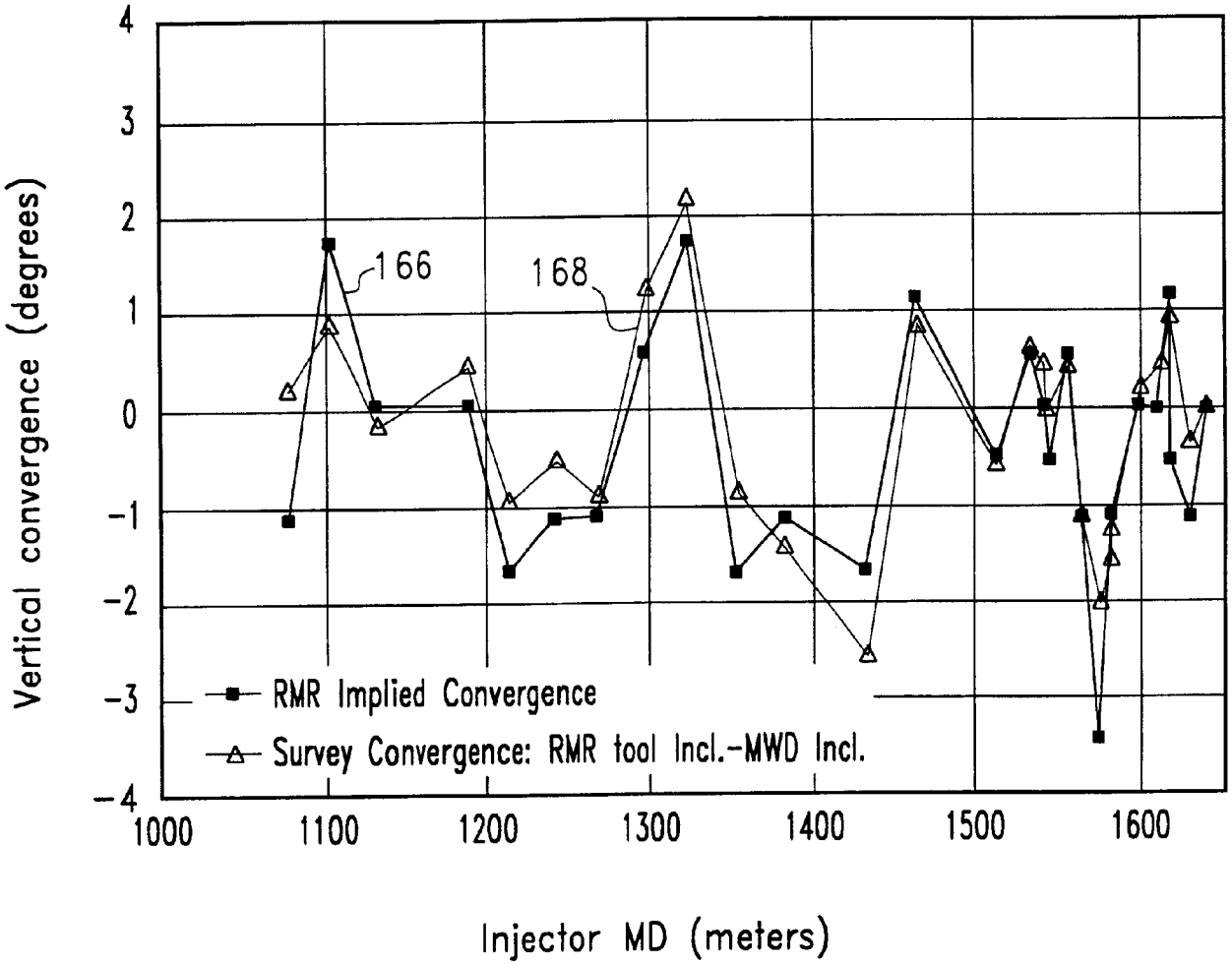
FIG. 10 is a graphical illustration of RM implied convergence compared the convergence/divergence derived from the difference of MWD inclination and Rotating Magnet tool inclination measurements in a reference well.

Vertical convergence of the two wells was determined from the relative amplitudes of the two Hz peaks as the drill bit moved past the sensor, or RMR tool. RMR Implied Convergence (graph 166), based solely on measured Hz amplitudes, is compared, in FIG. 10, with the convergence/divergence of the injector and producer (graph 168) based on MWD survey inclinations in the injector and RMR tool inclinations from the reference well 160. Only surveys where both peaks were recorded are shown. There is excellent agreement between RMR Implied Convergence and accelerometer based surveys, with any value greater than one-half degree correctly indicated. This test indicates that in the 'pass-by' mode with the sensor in a cased well, this method determined the convergence/divergence to within 1 degree. Evaluation of the convergence/divergence of the wells was directly determined over a 5 meter drilling depth interval during the last drill stem segment. This is in contrast to subtracting the MWD and rotating magnet tool inclinations 15 meters behind the current drill bit location. Thus an important drilling guidance advantage was demonstrated.

If the wells are not coplanar, i.e. the angle Ayv between them is not zero, the magnitude of the Hz component will have a minimum value HzMin but will not equal zero as in the coplanar case. At the depth where there is no contribution from the M*uUv*cos(wt) oscillator, the field from the M*vUv*sin(wt) oscillator is at a maximum and produces a dominant field component in the v direction. Since the wells are not coplanar, this field projects a small component on to the z axis which is proportional to the angle Ayv. The angle Ayv can be expressed as $$Ayv=1.72*Hz\mathrm{Min}/(Hz\mathrm{Max}\mathbf{1}+Hz\mathrm{Max}\mathbf{2}) \qquad \text{(Eq. 5)}$$

To find the sign of Ayv, it is noted that Hzmin is generated entirely by the magnetic dipole in the v direction, whose field almost entirely in the y direction. Thus the phase of Hzmin relative to Hy at the depth of "passby" can be used to give the sign of Ayv. The prediction of the relation Eq. 5 is more difficult to compare directly with the data available. The azimuthal direction of the well being drilled was poorly measured by the MWD sensors in the new borehole for the SAGD well pair drilled because the steel casing in the reference well perturbed the direction of the Earth's magnetic field at the MWD sensor location. This is the usual case when SAGD well pairs are being drilled. By noting the relative values of the peak signals Hz1, Hz2, and minimum Hzmin field and the relative phase of Hzmin to Hy, the relative angles, Axu and Ayv which give the deviation of the two wells from approximate parallelism can be found.

As in the case of determining borehole curvature, the Hz signal generated by the bent motor housing is readily separated by noting the modulation of the Hz signal while employing the rotation mode of drilling. Subtracting off the bent housing contribution to the Hz signals can be done using the same principles as in the bent housing application.

Another important point to note for the case of drilling parallel boreholes, as in SAGD well pairs, is that the reference well will usually be cased with steel tubing which means that the magnetometer is not in free space but in a tubular, magnetic shield. Such tubing, for the frequencies and tubing properties of concern, will usually have a minimal effect on the axial field component, i.e., the z component of an alternating magnetic field and will have a very substantial shielding effect (a factor of 10 or more) on the x and y field components, together with a substantial phase shift relative to that of Hz. The fact that the method requires only Hz measurements is thus important. Determination of the phase of Hzmin relative to Hy precisely enough to find the sign of the Hzmin signal relative to Hy is not a problem.

Figure 11:
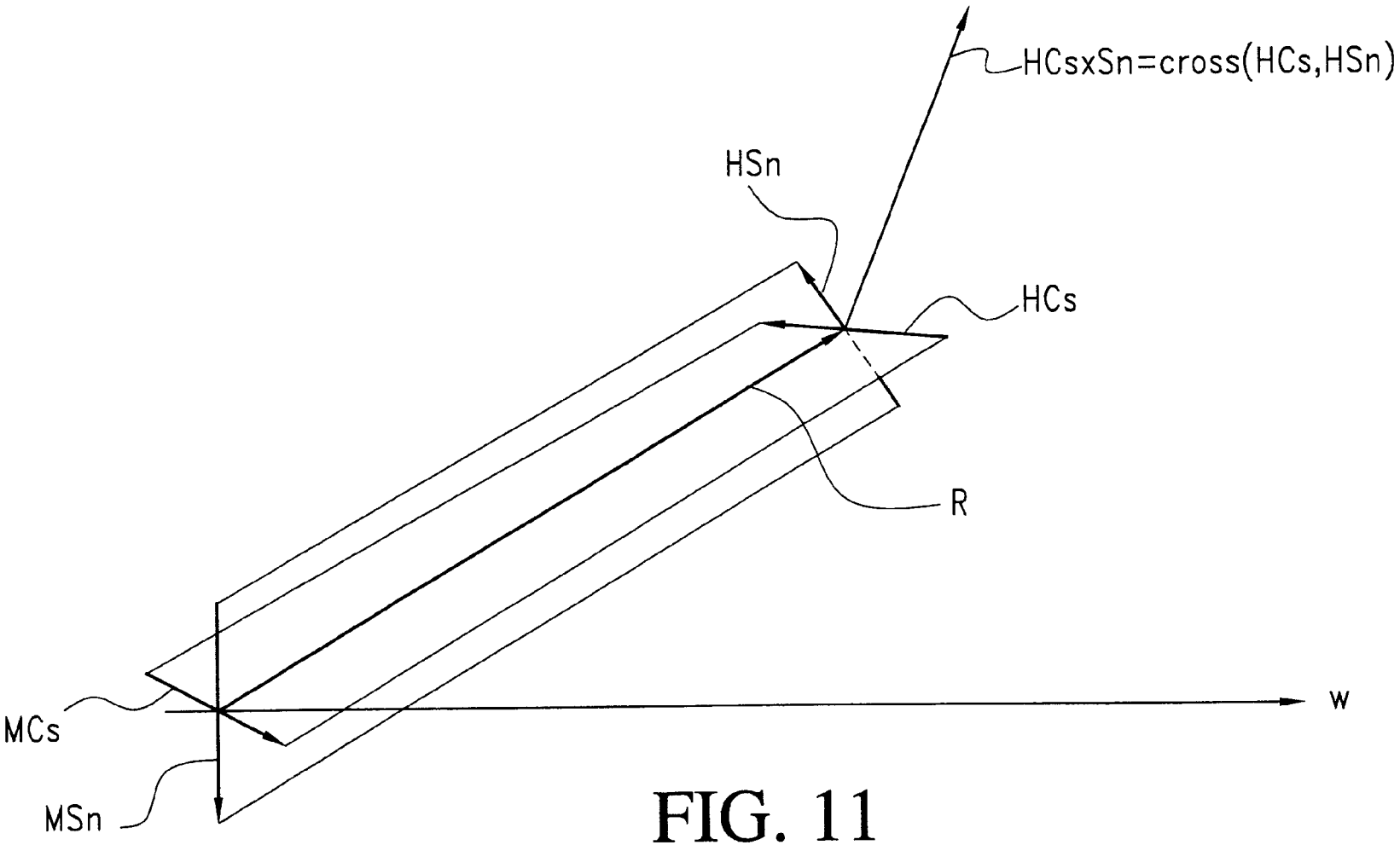
FIG. 11 is an illustration applicable to the third embodiment of the invention showing the relationship of important physical quantities.

FIG. 11, which complements FIG. 5, illustrates the physical and mathematical relationship relevant to the third embodiment of this invention. FIG. 11 displays directions of the relevant coordinate system and the angles to be evaluated from the measurements. In this discussion we again omit the corrective effects which may enter due to having the rotating magnet rotate at a small angle with respect to the borehole are again omitted. It should be noted, however, that these effects average to zero if measurements are made in the rotating mode of drilling. As disclosed earlier, the drilling assembly includes an MWD package which provides the current borehole direction at the point of that package. This borehole direction is projected ahead to the target location to give the best estimate of the borehole direction there. A driller does this routinely, using his experience and knowledge of whether the rotating or sliding mode of drilling have been used recently and how the hole has been behaving. Thus, the borehole direction at the drill bit is assumed to be known; it defines the direction w shown in FIG. 11. In addition, two other mutually perpendicular unit vectors u and v can be defined which are each perpendicular to w. For the case shown in FIG. 5, where an approximately horizontal well is to intersect a distant point, a natural choice for u is the high side direction to the new borehole and v the right side direction.

The sensor package at the target location incorporates x y and z component alternating magnetic field sensors together with a 3-component Earth's magnetic field magnetometer and a 3-component accelerometer package to provide spatial orientation. Thus, using the borehole direction w; i.e., the inclination and azimuthal heading of the new borehole generated by the MWD data, the unit vectors wUv, uUv and vUv are readily written in terms of the unit vectors xUv, yUv and zUv vectors defined by the alternating magnetic field sensors.

FIG. 11 shows important physical properties of the magnetic field produced. The rotating magnet can be represented by two independent oscillating magnetic dipoles MCs*cos (wt) and MSn*sin(wt), perpendicular to each other with equal strength, with unknown directions MCs and MSn. The MCs and MSn directions are perpendicular to each other and to the direction w. At the observation point, which is specified by the vector R from the dipoles, each dipole generates its own magnetic field, the first is HCs*cos(wt) and the second HSn*sin(wt). Each of these fields oscillates linearly in its own vector direction, i.e., HCs and HSn. MCs, R and HCs are coplanar, and MSn, R and HSn are coplanar. The magnetic field at the point R is said to be elliptically polarized, and HCs and HSn define a plane in which the field total field HCs*cos(wt)+HSn*sin(wt) lies, tracing out an ellipse as a function of time. A vector perpendicular to this plane HCsxSn and given by the vector cross product i.e., HCsxSn=cross(HCs,HSn), as indicated in FIG. 11, is a universal, characteristic field direction associated with a rotating magnetic field. This characteristic direction is inherent in all three embodiments of the invention. If the sensors measuring this field are inside a steel pipe, the characteristic direction becomes modified in predictable ways, as shown above.

Figure 12:
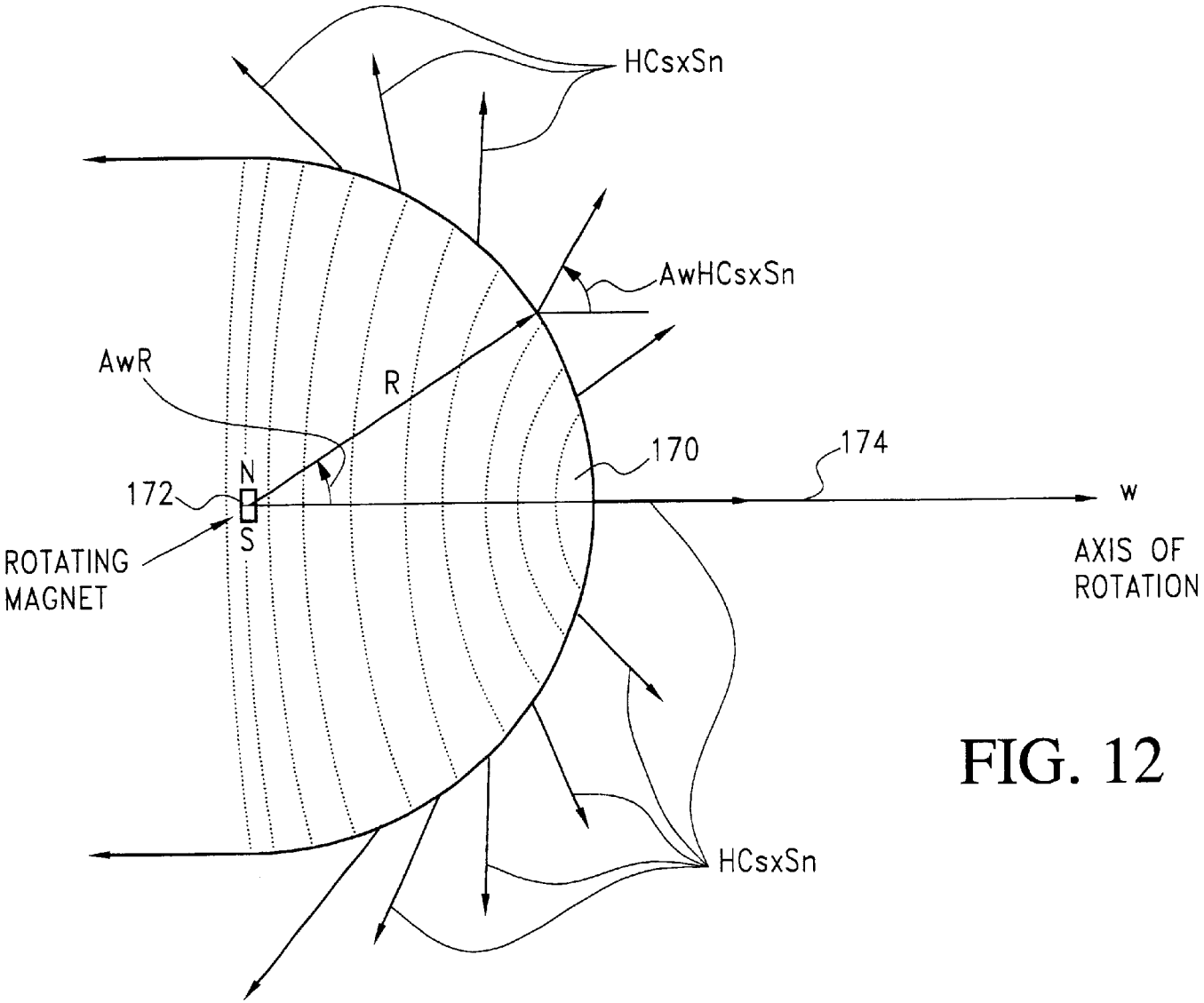
FIG. 12 is an illustration applicable to the third embodiment of the invention showing the azimuthal symmetry of the geometry and vectors used in the mathematical formulation.

FIG. 12 displays the vectors HCsxSn, R and the magnet's axis of rotation w to display the axially symmetric nature of the configuration. FIG. 12 shows a semispherical surface 170 centered on the rotating magnet source 172 and its axis of rotation 174. The direction of HCsxSn vectors at points on surface 170 are shown schematically. Though the action of the rotating magnet was represented as two linear, oscillating dipoles; in reality the magnetic source is a rotating magnet which has azimuthal symmetry, i.e., no special azimuthal orientation is evident. Thus, the behavior of the generated fields must have axially symmetric properties. For any given point on surface 170, the vector R from the rotating magnet, the HCsxSn vector associated with the alternating magnetic field at that point, and the w direction must be coplanar. The direction of HCsxSn with respect to the rotation axis w is different, in general, from angle of R with respect to w. At a point on the w axis, R, HCsxSn and w all point in the same direction. As one moves away from the axis the angle AwHCsxSn starts being equal to 3*AwR. By the time AwR=pi/2, AwHCsxSn=pi.

The relationship between the angles AwR and AwHCsxSn is readily computed, when limited to the forward hemisphere, i.e., where the angle AwR<pi/2. It is given by $$AwHCsxHSn = \text{atan } 2(3*\sin(2*AwR), (3*\cos(2*AwR)-1)) \quad \text{(Eq. 6)}$$

Figure 13:
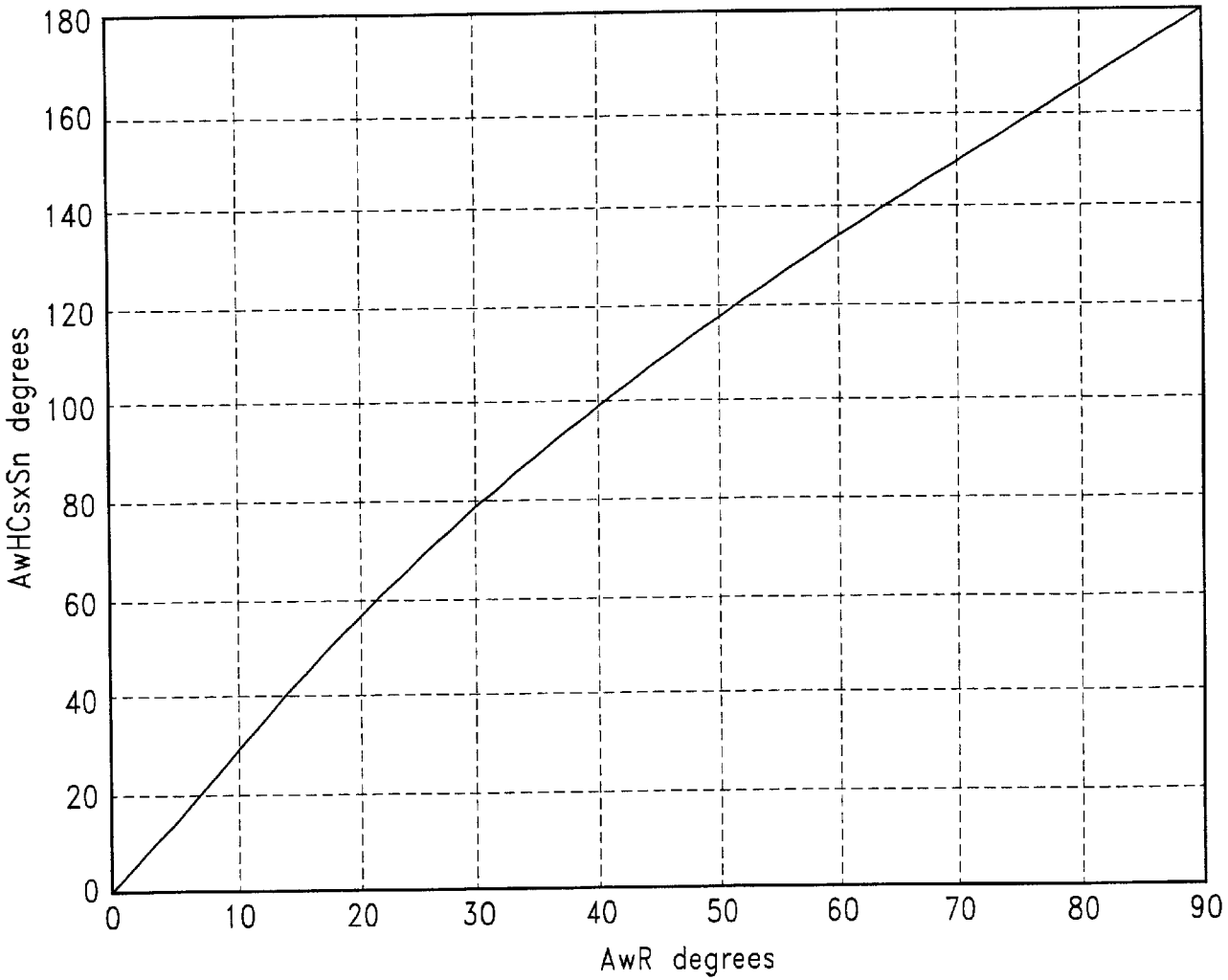
FIG. 13 is a graph applicable to the third embodiment of the invention showing the relationship between the angles AwHCsxSn and AwR.

While equation 6 cannot be solved explicitly for AwR from AwHCsxSn, the graph in FIG. 13 which displays the results of Eq. 6, is readily fitted to a simple polynomial to provide a computer function, which shall be called AwHCsxHSnToAwR. A statement in the computer program of the form AwR=AwHCsxSnToAwR(AwHCsxHSn) will then return AwR, given AwHCsxSn.

Figure 14:
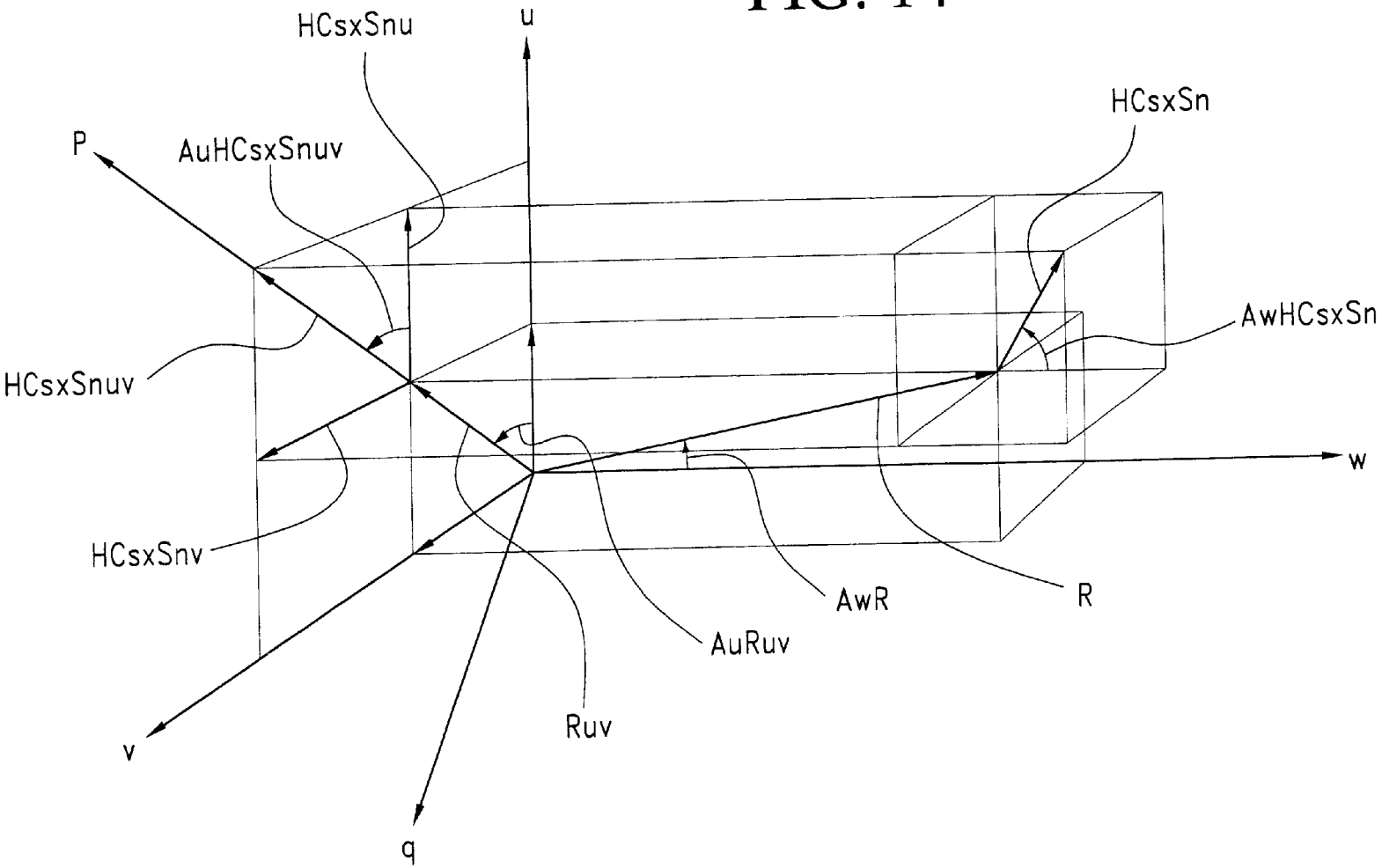
FIG. 14 is an illustration applicable to the third embodiment of the invention showing additional quantities used in the mathematical formulation.

The azimuthal direction about the w axis to the observation point at R with respect to the u,v,w axes can be specified by the angle AuRuv shown in FIG. 14. Ruv is the projection of the vector R onto the uv plane. The Ruv projection defines a direction p in the uv plane and a second perpendicular direction q in that plane as shown. AuRuv is the angle between the u axis and Ruv. Since HCsxSn, R and the rotation axis w are coplanar, the projection of HCsxSn on the uv plane, HCsxSnuv, points in the same direction as Ruv. Thus, the desired angle AuRuv is equal to AuHCsxSnuv which can be computed from the u and v components of HCsxSn, i.e. HCsxSnu and HCsxSnv.

It is useful to display several computer program lines which explicitly demonstrate the above. Consider the geometry shown in FIG. 5 where a dominantly horizontal borehole is to intersect a point in a vertical borehole, more or less directly ahead, in which an instrument package with the sensors discussed are included. At the outset it is known that the alternating magnetic field z axis sensor, which is by convention aligned with the tool axis, will have a large signal, thus the Hz signal is chosen to generate cosine and sine reference signals using the technique of a hilbert transform disclosed earlier. These reference sequences are then used to compute the HCs and HSn vectors and HCsxSn:

```
HilbHz=hilbert(Hz);
wt=atan 2(imag(HilbHz), real(HilbHz));
CsRef=cos(wt);
SnRef=sn(wt);
HCsx=2*mean(CsRef.*Hx);
HCsy=2*mean(CsRef.*Hy);
HCsz=2*mean(CsRef.*Hz);
HSnx=2*mean(SnRef.*Hx);
HSny=2*mean(SnRef.*Hy);
HSnz=2*mean(SnRef.*Hz);
HCsxSn=cross([HCsx HCsy HCsz], [HSnx HSny HSnz]);
HCsxSnu=dot(uUv,HCsxSn);
HCsxSnv=dot(vUv,HCsxSn);
HCsxSnw=dot(wUv,HCsxSn);
AuRuv=atan 2(HCsxSnv,HCsxSnu);
AwHCsxSn=atan2(sqrt(HCsxSnv^2+HcsxSnu^2),HCsxSnw);
AwRp=AwHCsxSnToAwRp(AwHCsxSn);
```

(Eq. 7)

The first block of program generates cos(wt) and sin(wt) reference sequences using a hilbert transform whose action was discussed earlier. The second two blocks generate the x y and z components of HCs and HSn from the original alternating field magnetometer data sets. Then the vector cross product of HCs and HSn are formed to produce HCsxSn. Elsewhere, earlier in the program, the unit vectors uUv, vUv and wUv, defined in the borehole being drilled, were expressed in terms of their x y z coordinates using the data from the Earth magnetic field magnetometers and Earth gravity sensors in the instrument package deployed in the target borehole. The next block of program steps utilize vector dot product routines to find the components of HCsxSn in the u v w coordinate system. Finally, the desired directions AuRuv and AwR are computed in the final block. The first line is based upon the direction of the projection of the HCsxSn vector on the uv plane coinciding with the direction of the projection of R; i.e., Ruv on that plane. The next line finds the angle between w and HCsxSn, i.e., AwHCsxSn by taking the arctangent of the projection of HCsxSn on the uv plane divided by the projection of HCsxSn on the w axis. Finally, using the subroutine AwHCsxSnToAwRp, alluded to earlier, converts this angle to AwR. Except for this last function, all the others used in these program lines are supplied by MATLAB.

The magnitude of the distance R to the observation point can be found using the direction AwR, the total field magnitude; i.e., sqrt(HCs^2+HSn^2) and the magnetic moment M of the source using well known mathematical relationships. Knowing the directions AwR and AuRuv and magnitude of R make geometrical computations possible to direct drilling not only toward the sensors but to a nearby point e.g. point 102 in FIG. 5.

Figure 15:
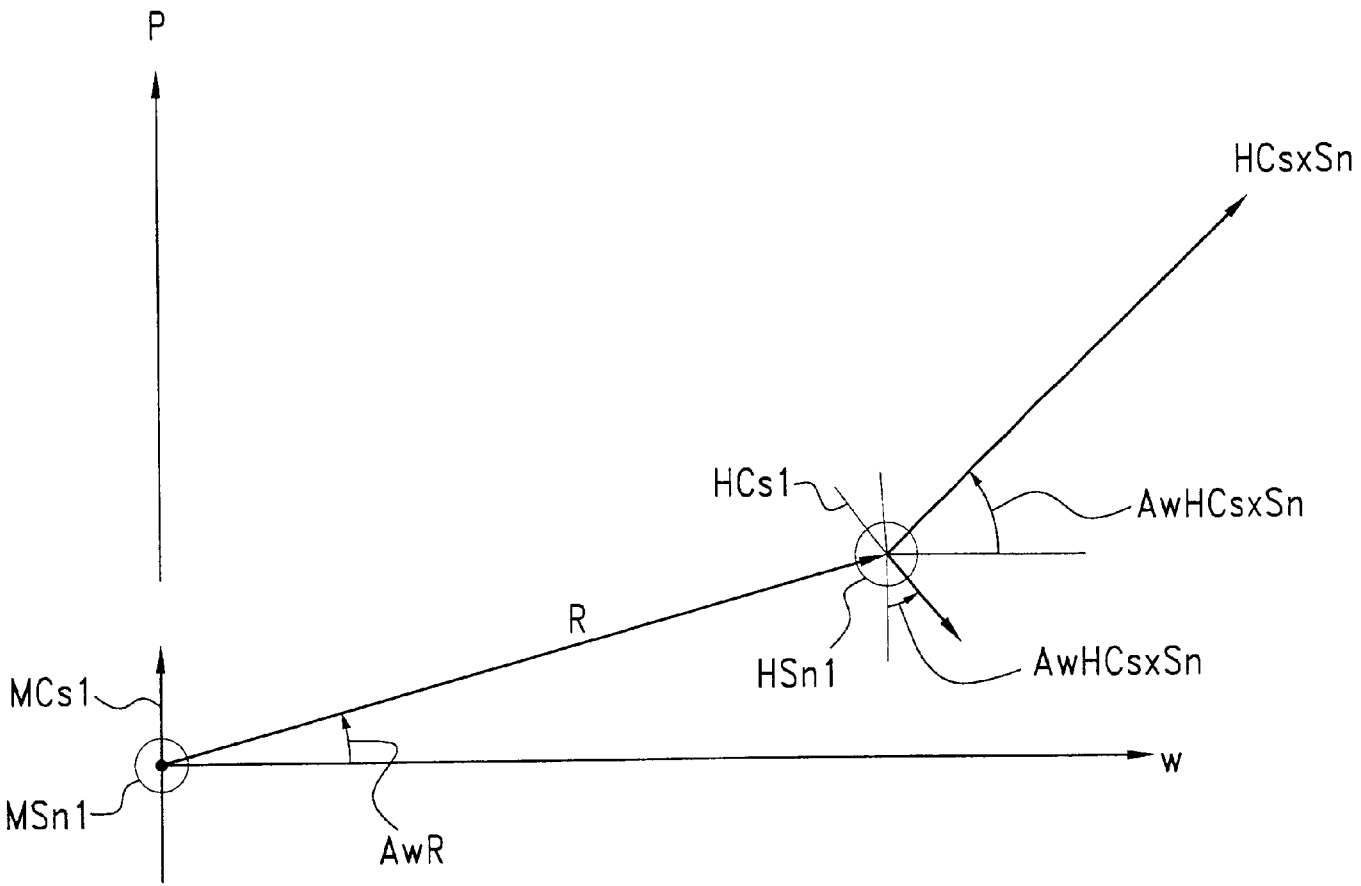
FIG. 15 is a diagrammatic view of the alternating magnetic field direction when the oscillating magnetic dipoles lie in and are perendicular to the plane defined by the direction to the target and the direction of the new borehole.

Another way of obtaining the angles AwR and AuRuv is from the vectors HCs and HSn themselves. Consider the configuration shown in FIG. 15 which would exist if the phase wt, defining instanteous orientation of the rotating magnet in the first block of equation steps (7), had added to it a constant phase Ph1, such that the orientation of the new vector MCs1 coincided with the plane defined by the direction vector to the observation point and the axis of the rotating magnet and MSn1 were perpendicular to it, as is illustrated in FIG. 15. This figure is a diagrammatic view looking down on the R w plane from the positive q direction defined in FIG. 14, a circle with an x inscribed indicates "seeing" the tail of the appropriate vector arrow indicated, a circle with a dot inscribed, the head of the appropriate vector arrow. In this case, the direction of the field HSn1 generated by the MSn1 oscillator is perpendicular to this plane, as shown, and the field HCs1 lies in the wR plane, as shown. Since HCs1 will be perpendicular to the vector HCsxSn discussed previously, the angle to HCs1 from the −p direction is the same as AwHCsxSn. Thus, determining the direction of HCs1 in this plane can be related to AwR using the graph of FIG. 13 and the function AwHCsxSnToAwR that is derived from it. If Ph1 is correct, the field HSn1 will have no w component; i.e., HSn1w=0 and the w component of HCs1, HCs1w>0.

The steps required to choose Ph1 to bring the above conditions about may be shown as follows. The HCs and HSn vectors generated by the program steps (7) are defined in the xyz coordinate system defined by the sensors (using MATLAB notation where the quantities between square brackets define a vector)

$$HCsXyz=[HCsx\ HCsy\ HCsz]$$

$$HSnXyz=[HSnx\ HSny\ HSnz] \quad \text{(Eq. 8)}$$

Since the unit vectors, of the uvw coordinate system are known in terms of the xyz unit vectors the HCs and HSn vectors can be transformed and written in terms of their uvw components by taking the dot products with uUv, vUv and wUv in a similar way as the next to last block of equations (7) where the components HCsxSn in the x y z coordinate system were converted to the u v w system. Thus, the vectors HCs and HSn can be written in terms a representation in the u v w system as:

$$HCsUvW=[HCsu\ HCsv\ HCsw]$$

$$HSnUvW=[HSnu\ HSnv\ HSnw] \quad \text{(Eq. 9)}$$

The total magnetic field H as a function of time can thus be written as $$H=HCsUvw*\cos(wt)+HSnUvw*\sin(wt) \quad \text{(Eq. 10)}$$

The w component of the field is thus:

$$Hw=HCsw*\cos(wt)+HSnw*\sin(wt) \quad \text{(Eq. 11)}$$

If instead of using wt as the reference phase in the procedures specified by (7) a phase Ph1 had been added to wt in the expressions and a different set of time reference functions CsRef1 and SnRef1 had been used:

$$Cs\text{Ref}\mathbf{1}=\cos(wt+Ph1)$$

$$Sn\text{Ref}\mathbf{1}=\sin(wt+Ph1) \quad \text{(Eq. 12)}$$

A new set of components HCsu1 . . . HSnw1 would replace HCsu . . . HSnw. The time dependance of the w component of the field, Hw in terms of these new quantities is:

$$Hw=HCsw\mathbf{1}*\cos(wt+Ph1)+HSnw\mathbf{1}*\sin(wt+Ph1) \quad \text{(Eq. 13)}$$

Expanding the cosines and sines functions in terms of sum and difference angle formulae, HCsw1 and HSnw1 can be found in terms of the HCsw and HSnw as in Eq. (11) as well as the other HCs1 and HSn1 component as:

$$HCsw\mathbf{1}=HCsw*\cos(P\mathbf{1})-HSnw*\sin(P\mathbf{1})$$

$$HSnw\mathbf{1}=HCsw*\sin(P\mathbf{1})+HSnw*\cos(P\mathbf{1})$$

$$HCsu\mathbf{1}=HCsu*\cos(P\mathbf{1})-HSnu*\sin(P\mathbf{1})$$

$$HSnu\mathbf{1}=HCsu*\sin(P\mathbf{1})+HSnu*\cos(P\mathbf{1})$$

$$HCsv\mathbf{1}=HCsv*\cos(P\mathbf{1})-HSnv*\sin(P\mathbf{1})$$

$$HSnv\mathbf{1}=HCsv*\sin(P\mathbf{1})+HSnv*\cos(P\mathbf{1}) \quad \text{(Eq. 14)}$$

The HSnw1 can be made zero if Ph1 is chosen as:

$$Ph\mathbf{1}=\text{atan}(-HSnw/HCsw) \quad \text{(Eq. 15)}$$

HSnw1, the orientation of the MSn1 oscillator is thus perpendicular to the R w plane. There are two ways to do this corresponding to the double valued nature of the Ph1 defined by (15). To make correspondance to FIG. 15, we choose the value of Ph1 to make HCsw1>0. Throughout this disclosure a clockwise direction of the drill bit rotation is assumed. Once the the phase Ph1 is found, all the other components of HCs1 and HSn1 can be found from the rest of the equations in the block (14).

To find the values of AwR elementary, trigonometric procedures are readily applied to w component of the vector HCs1 and the part of HCs1 perpendicular to w as indicated in FIG. 15 to find the angle AwHCsxSn shown. In finding AwHCsxSn the double valued inverse tangent evaluation encountered can be resolved by noting the ratio of the magnitudes of the HSn1 and HCs1 vectors. Once this angle is evaluated the graph of FIG. 13 can be utilized to AwR. To find AuRuv the argument of coplarity of HCs1 with R and w is noted, we obtain:

$$AuRuv=\text{atan } 2(-HCs1v,\ -HCs1u) \quad \text{(Eq. 16)}$$

Figure 16:
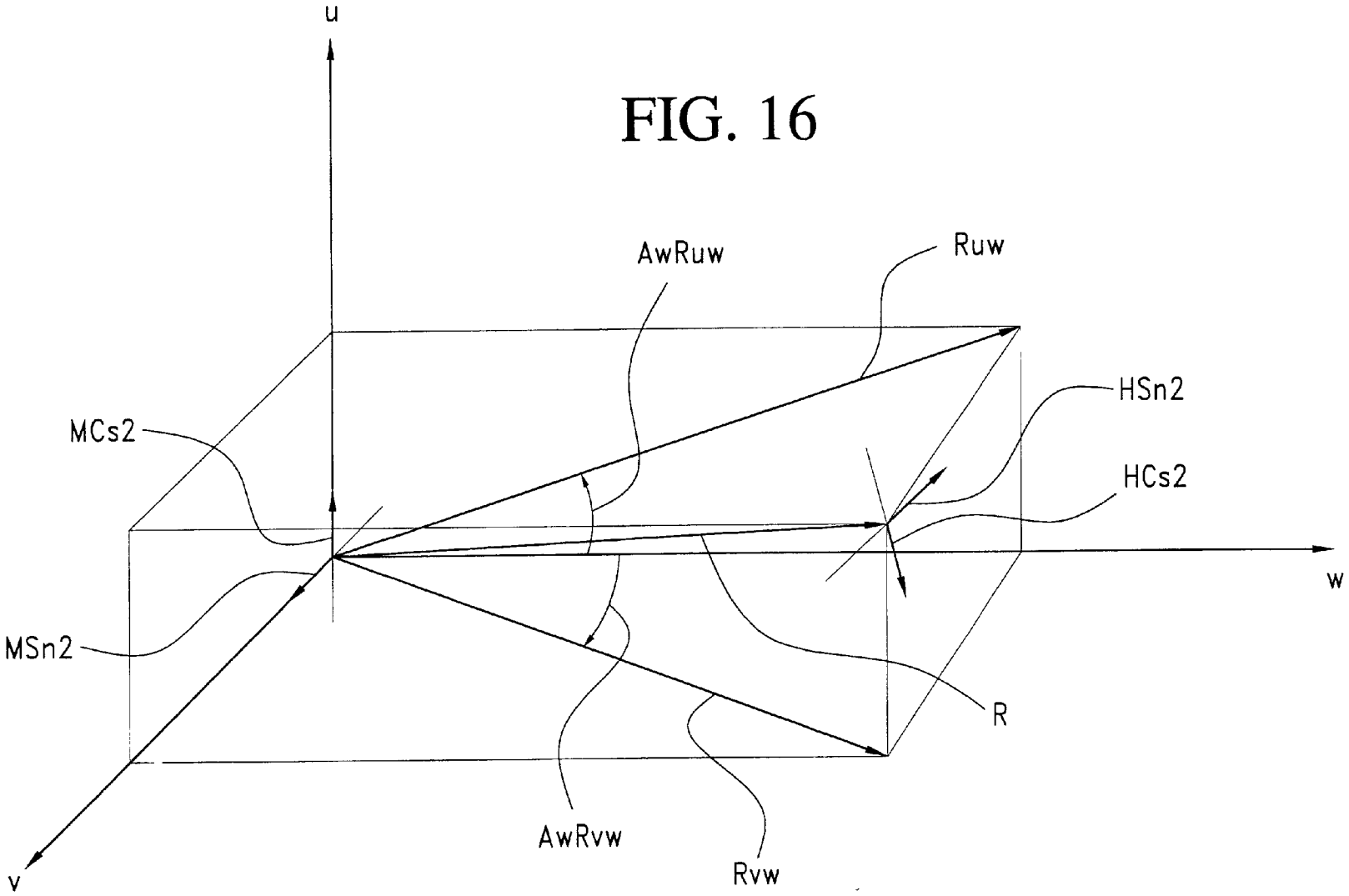
FIG. 16 is a diagrammatic view of the alternating magnetic field directions when the oscillating magnetic dipoles are oriented with respect to directions perpendicular to the new borehole axis, such as the high side and right side directions.

In the important, special case, when the target is almost straight ahead, i.e., when the angle AwR is small, another simplified analysis can be very useful. This case is shown in FIG. 16. It shows the oscillator direction of MCs2 to coincide with the u axis and the direction of the MSn2 axis to coincide with the v axis by an appropriate choice of a phase parameter Ph2. Then the field component in the u direction is almost entirely generated by the MCs2 oscillator, and the field in the v direction by the MSn2 oscillator. The three component Hw, Hu and Hv can then be worked out to be, for small angles AwR as:

$$Hu=HCsu2*\cos(wt+Ph2)=Hmag*\cos(wt+Ph2)$$

$$Hv=HSnv2*\sin(wt+Ph2)=Hmag*\sin(wt+Ph2)$$

$$Hw=HCsw2*\cos(wt+Ph2)+HSnw2*\sin(wt+Ph2)$$

$$HCsw2=3*AwRwu*Hmag$$

$$HSnw2=3*AwRwv*Hmag$$

$$Hmag=M/(4*pi*R\hat{}3) \quad \text{(Eq. 17)}$$

The phase angle Ph2 is chosen to make HSnu2=0 with the condition that HCsu2<0, or alternatively that HCsv2=0 with the condition that HSnv2<0 using the procedure as was done above to choose Ph1 to make HSnw1=0. In practice, Ph2 is computed in both ways and the average taken. Once Ph2 has been thus found, HCsu2, HSnv2, and HwCsw2 and HwSnw2 are computed using formulae similar to Eq 14. Then applying Eq. 16 one immediately obtains the angle to the right of the borehole and the angle up with respect to the borehole where the sensors are, if u and v were chosen as the high side and right side directions. In addition, one immediately finds the distance R from the magnitude Hmag=HCsu2 or alternatively Hmag=HSnv2.

In certain applications; e.g. in drilling directional boreholes using the jetting method, where the drill bit is not rotated continuously, it is desirable to interchange the location of the sensors and rotating magnet source. In such a case the alternating magnetic field and spatial orientation sensors would be deployed in the drilling assembly together and an oriented, remote, rotating magnetic field source in the form of a motor driven permanent magnet or an equivalent electromagnetic device at or near the target location. This configuration has important applications for the precise drilling of boreholes for the installation of underground pipelines and electrical and communication cables.

Figure 17:
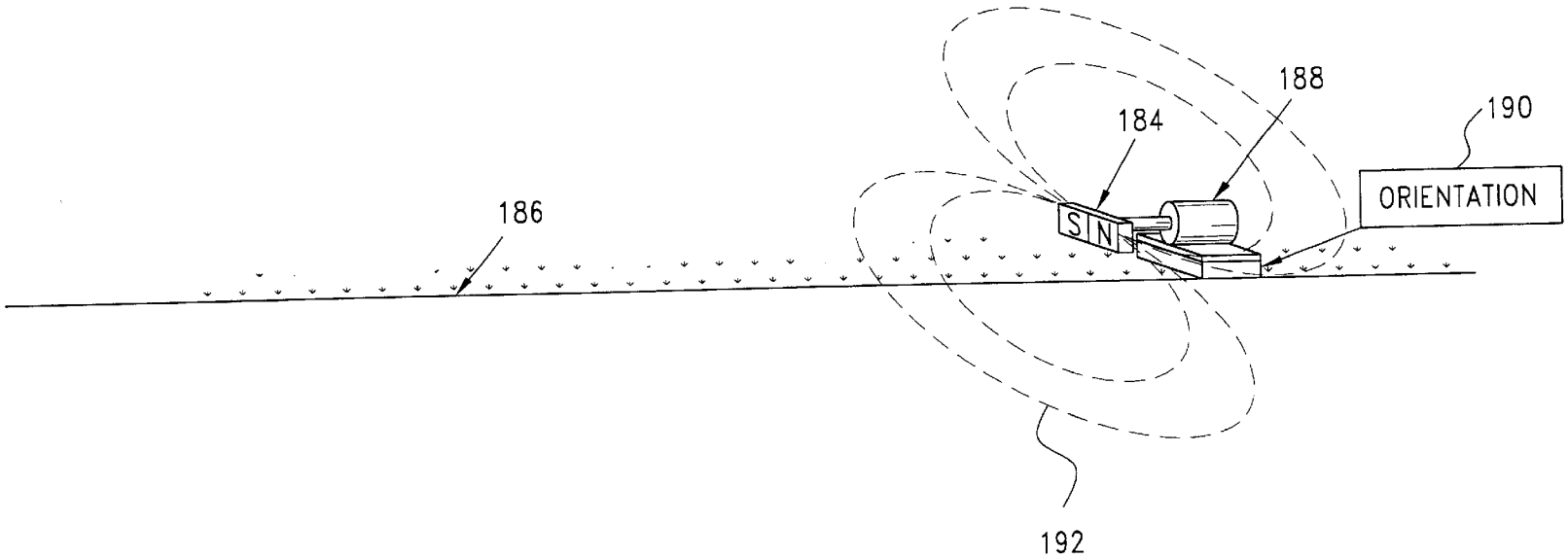
FIG. 17 is a diagrammatic view of a fourth embodiment of the invention.
Figure 17:
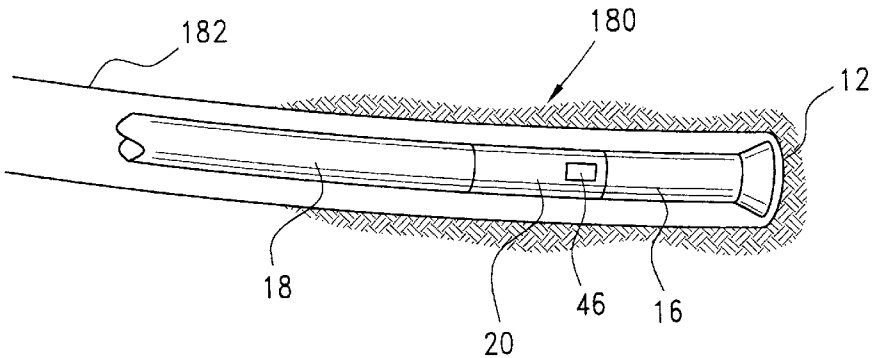

It will also be understood that the target location for a borehole being drilled need not be located underground. For example, as illustrated in FIG. 17, a drill assembly 180, which may be similar to those previously illustrated, may be used to drill a borehole 182 under the guidance of the field produced by a rotating permanent magnet 184 located at any arbitrary location; in this case, on the Earth's surface 186. The drill assembly includes a drill stem 18, nonmagnetic housing 20 for sensor package 46, and drill bit 12, as described above. The rotating magnet is driven by a motor, and the orientation of its axis of rotation is measured by sensors 190, which may be a level and compass, for example, or may be determined by surveyed landmarks.

The x, y and z vectors of field 192 produced by the permanent magnet are measured at sensor package 46, as described above, along with the orientation of the sensor package, to determine the relative distance and direction from the package 46 to the magnetic field source. This information is obtained in the manner illustrated in FIG. 3 and described above.

Although the invention has been described in terms of preferred embodiments, it will be understood that variations and modifications will become apparent to those of skill in the art without departing from the true spirit and scope thereof, as set out in the accompanying claims.

What is claimed is:

1. Apparatus for relative direction measurement, comprising:

a magnetic field generator comprising a magnetic field source mounted on an elongated, bendable drilling assembly for directional drilling of a borehole to produce curvature in the borehole, said source producing a magnetic field at a first point on said drilling assembly and having a first axis passing through said first point;

a first detector for measuring three vector components of said magnetic field, said first detector being mounted at a second point spaced from said source point on said drilling assembly;

a second detector for determining the roll angle orientation of said first detector; and means for determining from said measured vector components a relative direction of said first axis and for determining from said relative direction the curvature of said borehole.

2. The apparatus of claim 1, wherein said magnetic field generator generates a rotating magnetic field.

3. The apparatus of claim 2, wherein said magnetic field generator comprises a permanent magnet mounted on a rotating portion of said drilling assembly for rotation therewith.

4. Apparatus for relative direction measurement, comprising:

a magnetic field generator for producing a rotating magnetic field having a source point and having a first axis passing through said point, wherein said magnetic field generator comprises at least one permanent magnet mounted for rotation with an elongated bendable rotatable drilling assembly in a borehole operable for directional drilling of said borehole to produce curvature in said borehole, said first axis being substantially parallel to the direction of drilling said borehole;

a first detector for determining the orientation in space of said field generator;

a second detector mounted on said drilling assembly at a location spaced from said permanent magnet for measuring three vector components of said magnetic field at a second point spaced from said source point; and means for determining from said measured vector components a characteristic direction associated with said rotating field at said second point and for determining the relative orientation of said first axis with respect to said characteristic direction.

5. The apparatus of claim 4, wherein said magnetic field generator is a permanent magnet is located at said source point and rotatable about said first axis.

6. Apparatus for relative direction measurement, comprising:

a magnetic field generator for producing a rotating magnetic field having a source point and having a first axis passing through said point;

a first detector for determining the orientation in space of said field generator;

a second detector for measuring x, y and z vector components of said magnetic field at a second point spaced from said source point; and means for determining from said measured vector components a characteristic direction associated with said rotating field at said second point and for determining the relative orientation of said first axis with respect to said characteristic direction, wherein said magnetic field generator is at the earth's surface and said second detector at said second point is located in a borehole.

7. The apparatus of claim 6, wherein said second detector is movable in a borehole to permit surveying of said borehole.

8. A method of relative direction measurement, comprising:

generating a magnetic field at a first point in a borehole, said magnetic field having a first axis passing through said first point;

measuring, at a second point in said borehole remote from said first point, x, y and z vector components of said generated magnetic field determining the roll angle of the x, v and z vector component directions relative to the borehole;

determining a direction of the first axis relative to the x, y and z vector component directions; and determining the relative direction of the borehole with respect to said first axis.

9. The method of claim 8, further including locating said first and said second points at spaced locations along a borehole, whereby determining the direction of said first axis relative to the direction of the borehole measures the curvature of the borehole between said points.

10. The method of claim 8, wherein generating a rotating magnetic field comprises mounting a permanent magnet on a rotary portion of a drill assembly.

11. The method of claim 8, further including:

locating said first point on a rotary drill portion of a drill assembly; and locating said second point on said drill assembly.

12. The method of claim 11, further including correcting measured x, y and z vector components for variances of said first axis from the axis of said drill assembly.

13. The method of claim 11, wherein generating said magnetic field comprises generating a rotating magnetic field.

14. The method of claim 13, wherein determining a direction of the first axis includes obtaining the cross product of said measured vector components to derive a characteristic direction associated with said rotating magnetic field.

15. A method of relative direction measurement, comprising:

generating a rotating magnetic field having a first axis and having a source point;

determining the orientation in space of said first axis;

measuring x,y and z vector components of said rotating magnetic field at a second point remote from said first point;

obtaining a derived direction from said measured x, y and z vector components of said second point;

determining the direction of said first axis relative to said derived direction;

locating said source point on a rotary drill portion of a drill assembly in a borehole; and locating said second point on said drill assembly at a location spaced from said source point.

16. The method of claim 15, further including correcting said measured x, y, and z vector components for variances of said first axis from the axis of said drill assembly.

17. A method of relative direction measurement, comprising:

generating a rotating magnetic field having a first axis and having a source point;

determining the orientation in space of said first axis;

measuring x, y and z vector components of said rotating magnetic field at a second point remote from said first point;

obtaining a derived direction from said measured x, y and z vector components of said second point, wherein obtaining said derived direction includes obtaining the cross product of said measured vector components to derive a characteristic direction associated with said rotating magnetic field; and determining the direction of said first axis relative to said derived direction.

18. A method for relative direction measurement, comprising:

generating a rotating magnetic field at a first point on the earth's surface, said field having an axis passing through said point;

measuring, at a second point located in a borehole extending beneath the earth's surface, three x, y and z vector components of said rotating magnetic field;

measuring the roll angle of the measured x, y and z vector components relative to the axis of the borehole, and determining, from the measured x, y and z vector components and from the measured roll angle, the direction of the borehole relative to the axis of said rotating magnetic field.

19. The method of claim 18, wherein generating said rotating magnetic field includes rotating a permanent magnet located at said first point.

20. The method of claim 18, further including continuously determining the relative direction of the borehole along its length for surveying the borehole.

21. Apparatus for relative direction measurement, comprising:

a magnetic field generator at a first source point located on the earth's surface and providing a magnetic field having a first axis passing through said first source point;

a first detector for measuring three vector components of said magnetic field at a second point located in a borehole beneath the earth's surface;

a second detector for measuring the roll angle orientation of said first detector; and means responsive to said measured vector field components and said measured roll angle orientation for determining the direction of said borehole relative to the first axis.

22. The apparatus of claim 21, wherein said magnetic field generator comprises a rotating permanent magnet.

23. The apparatus of claim 21, wherein said first detector is movable in said borehole for surveying said borehole.

* * * * *